US005820526A

United States Patent [19]

Hoffman

[11] Patent Number: 5,820,526

[45] **Date of Patent: *Oct. 13, 1998**

[54] EXERCISE APPARATUS

[75] Inventor: Ned Hoffman, Berkeley, Calif.

[73] Assignee: Excel Innovations, Inc., Berkeley, Calif.

[ * ] Notice: The term of this patent shall not extend beyond the expiration date of Pat. No. 5,468,200.

[21] Appl. No.: 408,894

[22] Filed: Mar. 22, 1995

Related U.S. Application Data

[63] Continuation-in-part of Ser. No. 669,177, Mar. 14, 1991, Pat. No. 5,468,200, which is a continuation-in-part of Ser. No. 398,360, Aug. 25, 1989, Pat. No. 5,004,227, which is a continuation-in-part of Ser. No. 289,191, Dec. 23, 1988, Pat. No. 4,923,418.

[51] Int. Cl.[6] ..... A63B 31/04; A63B 21/06

[52] U.S. Cl. ..... 482/55; 482/105; 441/57

[58] Field of Search ..... 482/55, 105; 2/250; 441/56–58

[56] References Cited

U.S. PATENT DOCUMENTS

| | | | |
|---|---|---|---|
| 1,329,073 | 1/1920 | Czicziriga | 441/57 |
| 2,169,939 | 8/1939 | Anderson | 441/57 |
| 2,725,561 | 12/1955 | Blep | 2/19 |
| 3,098,234 | 7/1963 | Latina | 2/19 |
| 3,203,006 | 8/1965 | Shirey | 482/105 X |
| 3,231,910 | 2/1966 | Tegland | 441/57 |
| 3,257,673 | 6/1966 | Rademacher | 9/308 |
| 4,058,863 | 11/1977 | Ferdico | 441/57 |
| 4,195,365 | 4/1980 | Eyman | 441/57 |
| 4,247,097 | 1/1981 | Schwartz | 272/119 |
| 4,253,660 | 3/1981 | Tiktin | 482/105 X |
| 4,258,914 | 3/1981 | Lalli | 272/71 |
| 4,279,681 | 7/1981 | Klimezky | 2/19 X |
| 4,326,706 | 4/1982 | Guthrie et al. | 272/119 |
| 4,330,120 | 5/1982 | Netti | 272/119 |
| 4,345,335 | 8/1982 | Shih-Li | 2/161 X |
| 4,366,580 | 1/1983 | Zidele | 2/19 |
| 4,368,883 | 1/1983 | Tiktin | 482/105 X |
| 4,371,983 | 2/1983 | Piotti, Jr. | 482/105 X |
| 4,548,588 | 10/1985 | Kosuge | 441/57 |
| 4,561,122 | 12/1985 | Stanley et al. | 2/161 A X |
| 4,669,991 | 6/1987 | Southworth | 441/57 |
| 4,684,123 | 8/1987 | Fabry | 272/119 |
| 4,746,313 | 5/1988 | Bray et al. | 441/57 |
| 4,755,158 | 7/1988 | Wise | 441/57 |
| 4,809,366 | 3/1989 | Pratt | 2/161 A X |
| 4,923,418 | 5/1990 | Hoffman | 482/105 X |
| 4,964,174 | 10/1990 | Martin | 2/163 X |
| 5,004,227 | 4/1991 | Hoffman | 482/105 |
| 5,468,200 | 11/1995 | Hoffman | 482/105 X |

FOREIGN PATENT DOCUMENTS

| | | | |
|---|---|---|---|
| 224507 | 1/1959 | Australia | 2/250 |

*Primary Examiner*—Richard J. Apley
*Assistant Examiner*—John Mulcahy
*Attorney, Agent, or Firm*—Ali Kamarei

[57] ABSTRACT

An exercise glove for strapping weights (108) to a user's hand. The exercise glove may be used in water for swimming or on land for jogging or other exercise. A weight is inserted into a pocket (106) on a support (103) for placement on the backhand portion of the user's hand. The weight is removable from the pocket to permit variability of the amount of weight carried in proportion to desired muscle stress. The exercise glove may include a plurality of pockets for insertion of a plurality of weights. For use in swimming or other water sports the glove includes webbing (170) extending between form fitting finger sleeves (118), which cooperates with the weights (106) to provide improved training. The glove may also be formed with quick-removal loops (402) in place of or in addition to the webbing (170).

11 Claims, 35 Drawing Sheets

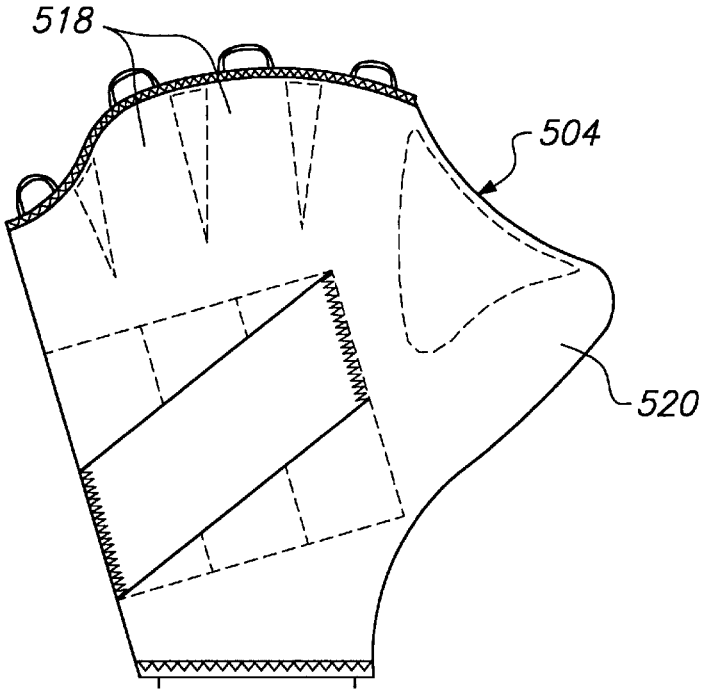
FIG. 39A
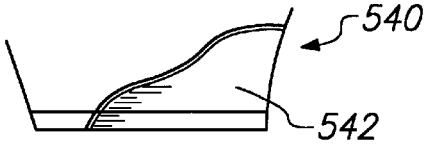
FIG. 39C
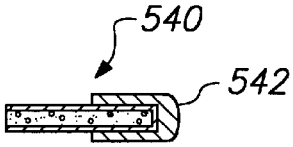
FIG. 39B
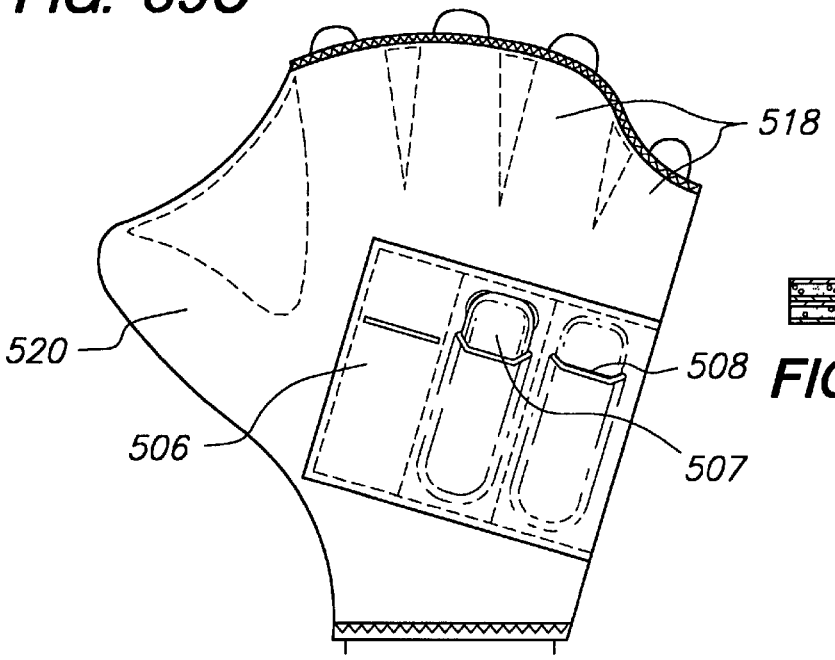
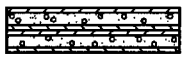
FIG. 40B
FIG. 40A

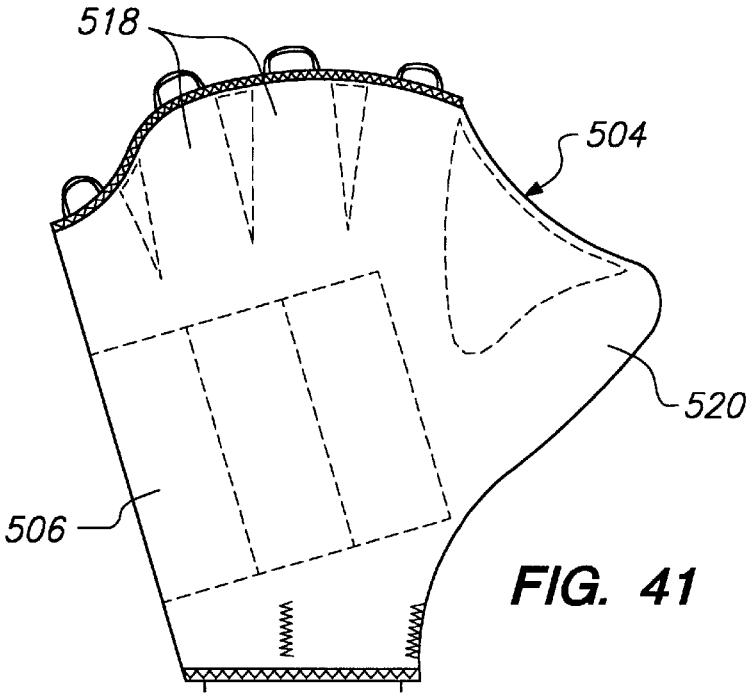
FIG. 41
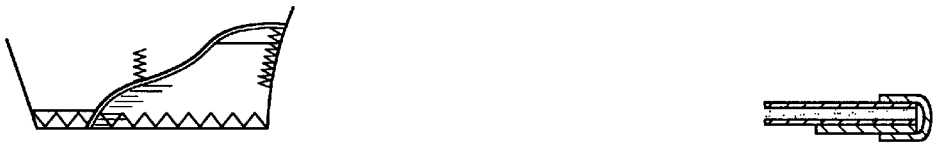
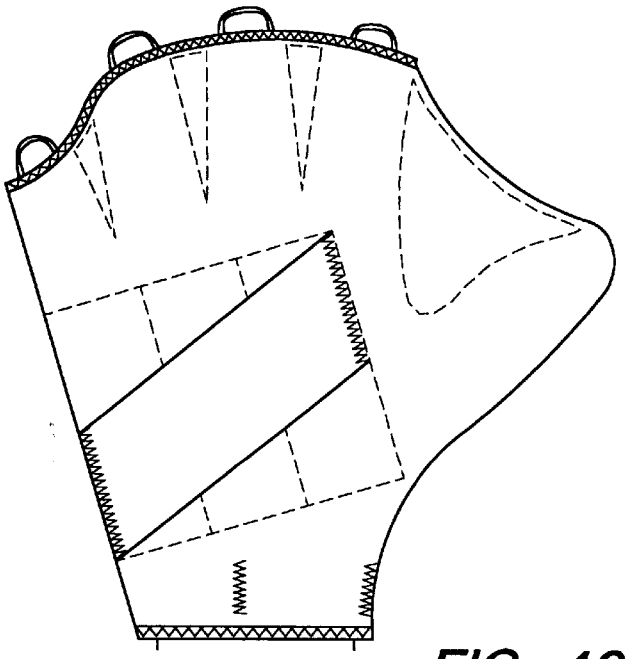
FIG. 42

EXERCISE APPARATUS

This application is a continuation-in-part of application Ser. No. 07/669,177, filed Mar. 14, 1991, now U.S. Pat. No. 5,468,200; which is a continuation-in-part of application Ser. No. 07/398,360, filed Aug. 25, 1989, now U.S. Pat. No. 5,004,227; which is a continuation-in-part of application Ser. No. 07/289,191, filed Dec. 23, 1988, now U.S. Pat. No. 4,923,418.

FIELD OF THE INVENTION

This invention relates generally to apparatus for enhancing beneficial muscle stress and aerobic capacity during exercise, and more particularly to such apparatus designed for use with the hand and wrist.

BACKGROUND OF THE INVENTION

Athletes often attempt to maximize the benefit of various physical activities by using equipment that is specially designed to increase speed and efficiency of muscular exercise. Although repetition of muscular movement will eventually tire and thus somewhat exercise muscle tissue, such repetitive exercise is inefficient and often insufficient to produce a significant increase in muscular development and strength. As an alternative to repetitive movement, athletes often seek to increase resistance to a particular bodily movement in order to increase muscular effort and thereby exercise muscle tissue more quickly and efficiently.

Resistance can be achieved in a variety of ways. Swimmers, for example, may wear gloves having webbing formed between adjacent fingers to enhance buoyancy and control. Webbing also increases the effective surface area of the glove making the swimmer's hand, and by extension his arm, more difficult to move through the water during exercise, enhancing both aerobic efficiency and speed of the swimmer.

Although aquatic exercise gloves are known, existing configurations suffer several important deficiencies. For example, many such prior art gloves are manufactured from problematic materials that stretch out of shape and thus cease to fit snugly after repeated wearing, particularly in the wrist region. This loss of fit reduces the swimmer's control hand and arm movement during aquatic exercise and often results in the inadvertent, undesired loss of the glove as water passes by the loose fit and into the interior of glove causing it to inflate and pull away from the swimmer's hand during exercise. Gloves fabricated from these materials are frequently not durable after repeated use, particularly in hard water and salt water environments. Furthermore, the material of prior art gloves is frequently water-permeable, causing the glove to increase in weight as water is absorbed during exercise; reducing the effectiveness of the webbing in creating drag; and making the glove a poor insulator. Structurally, existing swim gloves are awkward and inefficient to use. For example, current aquatic exercise gloves fully enclose the user's fingers within the material of which the glove is made, significantly reducing both the range of motion and the tactile sensitivity available to the fingers. Loss of such sensitivity, particularly at the finger tips, impedes the user's ability to gauge aerobic efficiency by preventing the user from taking his pulse when the gloves are worn. Further, because such gloves have closed finger ends, they must be manufactured in variety of sizes in order to accommodate different finger lengths. Such gloves also lack the structural and compositional features to necessary to ensure that the glove retains a snug fit to the swimmer's wrist after repeated use.

In addition to the structural and mechanical problems described above, all existing aquatic exercise gloves exhibit a critical functional limitation: exercise enhancement is accomplished by increasing resistance of hand and arm motion only when passing through water, even though a significant amount of movement in swimming takes place in air as well. This failure to exploit the full range of a swimmer's movement to exercise muscle is a significant failure of existing aquatic exercise gloves. Reliance on water resistance also significantly limits the utility of known gloves because they generally cannot adjust the glove to provide for variable resistance. This is because resistance is a generally achieved by increasing the surface area of the glove, a structural feature of the glove that cannot be easily adjusted or changed.

Unlike swimming, enhancement of aerobic workout and exercise efficiency in terrestrial environments generally relies on the use of weights. Joggers, for example, have turned to carrying weights while running in order to increase exercise of the upper body and limbs.

U.S. Pat. No. 4,326,706 to Guthrie et al. relates to a jogging glove for carrying two weights: a first weight disposed on the palm side of the hand and a second weight disposed on the back side of the hand. The total weight carried by the glove may be varied by changing only the palm weight. In theory, the weight on the back of the hand is permanently bound into the glove to avoiding misshaping and bulging of the metacarpal area on the back hand of the glove and to avoid interference with normal movement of the user's wrist. In practice, the prior art leaves weights to shift arbitrarily, thereby causing discomfort and irritation to the metacarpal bones and tendons of the back of the hand. Also, permanent backhand weights limit the function of prior art as weights cannot be significantly varied to accommodate different levels of fitness and arm motions in various sports.

Known weighted exercise gloves also suffer unavoidable limitations that are inherent to glove design. For example, it would be very desirable to have a one-size-fits-all weighted athletic apparatus that could be quickly and securely attached to the hand without the need for a glove as a support. It would also be very desirable if the same design could be utilized in many different sports. Neither of these goals is fully obtainable with current gloved exercise apparatus because gloves must be sized for a satisfactory fit and because the specific nature of most athletic activity dictates specific glove design features that may be undesirable in another sport.

Further complicating the use of both weighted and non-weighted gloves is the preference for a form-fitting design which is frequently made half-fingered by omitting some or most of the finger sleeve above the proximal phalange of the finger. Such a design to permits the athlete's finger tips to protrude freely from the glove increasing both the range and efficiency of finger movement and preserving tactile sensitivity. However, such gloves do exhibit certain drawbacks. For example, form-fitting gloves are notoriously cumbersome to remove after use, particularly if the glove has become wet due to perspiration or the elements. The wearer must adjust and pull each finger sleeve separately and repeatedly in order to free the glove from the hand. Further, gloves are frequently undesirable in endurance or long distance athletic activity, particularly in summer, when maintaining heat loss through the hands is important.

It will be appreciated from the foregoing that there is a need for hand-adapted terrestrial exercise apparatus that allows the user to vary the resistance in a desired muscle group during exercise according to the needs of the user, while at the same time not limiting the user to a particular athletic activity or range of motion.

There is a further need for a hand-adapted exercise apparatus that can be produced in one configuration that can be adjusted to fit most hand sizes. There is also a need for an aquatic exercise glove that is capable of enhancing muscular resistance and aerobic workout throughout full range of a swimmer's movements, whether under water or in air. Yet another need in an aquatic exercise glove is for the capability of varying the amount of resistance precisely and controllably in order to maximize the benefit of the exercise. Further, there is a need for such adjustability to be accomplished quickly and efficiently, particularly when exercise is in progress.

There is also a need for an aquatic exercise glove that is fabricated from a material that is impermeable to water in order to maximize water resistance relative to glove surface area; that is a poor conductor of heat in order to maximize insulative quality; and that is substantially inert to the harsh chemical effects of hard water and salt water.

There is clearly a need for an aquatic exercise glove that holds its shape, particularly in its grip about the wrist, in order to increase comfortability and decrease risk of glove loss during exercise.

There is further a general need for an inexpensive and substantially uniform means for facilitating the removal of form-fitting gloves, including gloves that are configured to be half-fingered or full fingered.

SUMMARY OF THE INVENTION

In view of the many limitations and drawbacks of prior art hand-adapted exercise apparatus, and in view of the many long felt needs associated therewith, it is a first general object of the invention to provide a versatile, single-size, hand-adapted, weighted exercise apparatus that does not include an athletic glove as a component and that is fully adjustable to each individual's hand size.

It is another object of the invention to provide a hand-adapted, weighted exercise apparatus that is equally useful in a variety of athletic activities, both on land and in the water.

A second general object of the invention is to provide an improved, hand-adapted, gloved aquatic exercise apparatus that is durable in harsh conditions; that maintains a snug and comfortable fit (particularly about the wrist) after repeated use; that insulates the athlete's hands from cold water conditions; that maintains the athlete's manual dexterity and tactile sensitivity in the fingertips; and that is substantially impermeable to water even during protracted periods of use.

A further object of the invention is to provide an aquatic exercise glove that permits enhancement of muscle tension and aerobic efficiency throughout a 360 degree range of motion, whether the swimmer's hand be in water or air.

Appurtenant to the foregoing object is the provision of an aquatic exercise apparatus that can be adjusted to vary the degree of enhancement of muscular tension to suit a particular activity or individual level of conditioning.

Yet another object of the invention is to provide an amphibious weighted exercise apparatus that is equally useful in both terrestrial and aquatic athletic activities.

The present invention has as a third general object the provision of a universal quick removal means for facilitating the removal of form-fitting gloves of all types, particularly athletic gloves.

The invention meets these objects by providing the following categories of exercise apparatus which are described in detail below:

gloveless, adjustably weighted, hand-adapted exercise apparatus for both terrestrial and aquatic athletic activities; gloved, adjustably weighted and non-weighted, webbed aquatic exercise apparatus with wrist reinforcement closure system; gloved, weighted, non-webbed amphibious exercise apparatus; a quick removal means for facilitating removal of any glove, but particularly suited to form-fitting glove designs.

Turning first to gloveless exercise apparatus, the present invention provides an improvement to the gloveless exercise apparatus disclosed and claimed in my U.S. Pat. No. 5,004,227. The embodiment disclosed herein further enhances muscle stress and aerobic value of exercise, permitting the user to attach weights comfortably and securely to his hands, without need for continual grasping of the weights during exercise that would otherwise be required to keep the weights from moving or being lost from the hand during exercise. The embodiment comprises comprises a padded weight carrier and one or more removable weights in combination of a palm strap and wrist strap, each of which is provided with hook and loop [closures] fastener, also known as Velcro, for securing the weights to the backside of the user's hand. This embodiment represents an improvement over my previous design in that the palm strap is provided with only one free end that is threaded through a ring closure and fastened back upon itself. This configuration is both easier to use and more easily adapted to a user's hand than my previous design, which provided the palm strap with two free ends.

According to another aspect of the invention, various improved gloved exercise apparatus are disclosed. In a series of embodiments specially designed for swimming, webbing is provided between the finger sleeves or finger channels of the glove in order to exploit the resistance experienced by the arm and hand as it moves through the water. These embodiments may further include pockets for carrying one or more weights securely against the back of the user's hand. The weight may be held in position with a strap. Alternatively, weight-holding pockets may be formed in the backhand portion of the glove and may be configured to open to the interior or exterior of the glove. In embodiments having the pockets opening to the glove exterior, a flap may be added that can be folded and fastened over the openings of the pockets to assist in retaining the weights.

Weights have not before been used in aquatic exercise gloves largely because of the misbelief that swimmer buoyancy (and ultimately swimming speed) would be adversely affected. Surprisingly and unexpectedly, it has been discovered that weighted aquatic exercise gloves significantly enhance the aerobic efficiency of aquatic exercise as compared with non-weighted prior art gloves. This is because weights permit enhancement of muscular tension and aerobic efficiency both when the swimmer's hand is in air and in water, complimenting the enhancement provided by water resistance to the glove webbing. Because they lack weights or similar means, conventional swimming gloves are incapable of enhancing muscular resistance and aerobic workout when a swimmer's hand moves out of the water. This failure significantly limits the extent and quality of the overall aerobic efficiency of aquatic exercise.

Most surprising of all is the discovery that the use of weights alone in aquatic exercise gloves produces an aerobic enhancement that is at least as, if not more, pronounced than the aerobic enhancement provided by webbed aquatic exercise apparatus. It appears that during aquatic exercise, a swimmer's hands spend a considerable amount of time in the air and that even moderate weight addition can significantly increases muscle tension during this portion of the activity. Further, although unwebbed, the combination of the swimmer's hand and exercise glove do present significant surface area to the water, and thus enhance muscle tension and aerobic efficiency (although to a lesser degree than webbed gloves) in movement in water.

Further improvements provided by the invention over prior art aquatic exercise gloves are achieved through utilization of glove materials that have physical and chemical characteristics suited to aquatic environments. Glove materials contemplated by the invention include durable, flexible rubber/fabric meshes, such as a combination of Spandex for the glove and Gortex for webbing in one embodiment, or more preferably a chlorine-resistant, heat-insulating material, such as closed-cell Neoprene, which can be used to fabricate both glove and webbing. Neoprene is preferred for several reasons: (1) Neoprene absorbs little if any water from the surrounding medium thereby reducing glove weight variation during swimming; (2) Neoprene is an excellent insulator; (3) density and water impermeability of Neoprene increases webbing function, thereby maximizing muscle resistance and exercise efficiency in water.

In some aquatic exercise glove embodiments of the invention, means for securing the glove to the hand of the user in the proximity of the user's wrist is further provided. Such wrist securing means correct long-standing problems of blow-out and glove loss which result from overstretching of the wrist region of the glove which permits forced entry of water to the interior of the glove during exercise. For example, the wrist portion of the glove may include an elastic support band integral with the wrist portion material. Alternatively an externally mounted wrap-around strap with Velcro closures may be utilized. The hook and loop fastener is used in conjunction with a "D" or "O" ring closure, collectively referred herein as closure rings. This will enable securing and releasing the wrist closure system of the exercise apparatus using only one hand. This is especially important since with webbed gloves, manual dexterity is limited. The strap can be configured to mate with Velcro strips distributed along the wrist portion of the glove, or may be threaded through a ring closure hook and mated with itself.

Yet another aspect of the invention is reflected in a series of embodiments of gloves, including gloves, that are provided with a quick removal means. The quick removal means comprises one of variety of different grasping structures disposed generally in or adjacent to the proximal phalange region of the finger sleeves.

In a preferred series of embodiments, each pair of adjacent finger sleeves is interconnected a short distance above the finger sleeve crotch in the proximal flange region of the user's fingers. In gusseted gloves, the interconnection is preferably formed from a circular, continuous segment of material that is incorporated in the gussets. Alternatively, the interconnection may be formed from non-continuous, linear segments or arcs, which can be affixed, sewn, or formed integral with the finger sleeves, and which are particularly advantageous for use in gloves having a unitary as opposed to gusseted finger sleeve design. Interconnections may also be formed from a continuous strand of material that is then braided between each pair of adjacent finger sleeves. These three types of interconnections are functionally and structurally similar, and are collectively referred to as "loops" in the detailed description and the claims of the invention that follows. When removal of the glove is desired, the user inserts the fingers of the opposite hand beneath the loops and pulls outwardly away from the palm thereby greatly facilitating removal of the glove from the user's hand.

Although the loops may be disposed in any number of positions between adjacent finger sleeves as described above without impeding effectiveness of glove removal, such loops are preferably inserted at angle above the plane of the hand so that the loops glide out from between the fingers and project upwards above the backhand portion of the mitt. Such a configuration assures that the loops will neither provide discomfort nor interfere with athletic activity when the fingers are brought together or held in close proximity to one another.

BRIEF DESCRIPTION OF THE DRAWINGS

FIG. 39A is a backhand view of a fourth embodiment of the weighted and webbed aquatic exercise apparatus of the invention showing an elastic weight support band and an elastic support embodiment of the wrist securing means.

FIG. 39B is a partial cross-sectional view of the wristband of the embodiment shown in FIG. 39A showing the wrist securing means in greater detail.

FIG. 39C is a backhand view with partial cut away of the wrist band portion of the embodiment shown in FIG. 39A showing the wrist securing means in greater detail.

FIG. 40A is a backhand view with partial cut away of a fifth embodiment of the weighted and webbed aquatic exercise apparatus of the invention having internal weight pockets and the wrist securing means embodiment shown in FIGS. 39B and C.

FIG. 40B is a cross-section of the wrist band portion of the embodiment shown in FIG. 40A.

FIG. 41 is a backhand view of a variation of the embodiment shown in FIG. 33 configured to have the weight pockets open to the interior of the glove.

FIG. 42 is a backhand view of the embodiment shown in FIG. 41 further including a weight securing strap exterior to the weight pockets.

FIG. 45C is a view in cross section of a portion of the wrist band.

FIG. 61A is a backhand view of the first step in attaching to a hand a first embodiment of the gloveless, weighted exercise apparatus of the invention, showing the weight holders placed on the back of the hand with the weight pockets exposed.

FIG. 61B is a palm view of the first step in attaching to a hand a second embodiment of the gloveless, weighted exercise apparatus of the invention.

DETAILED DESCRIPTION OF THE INVENTION

Figure 1:
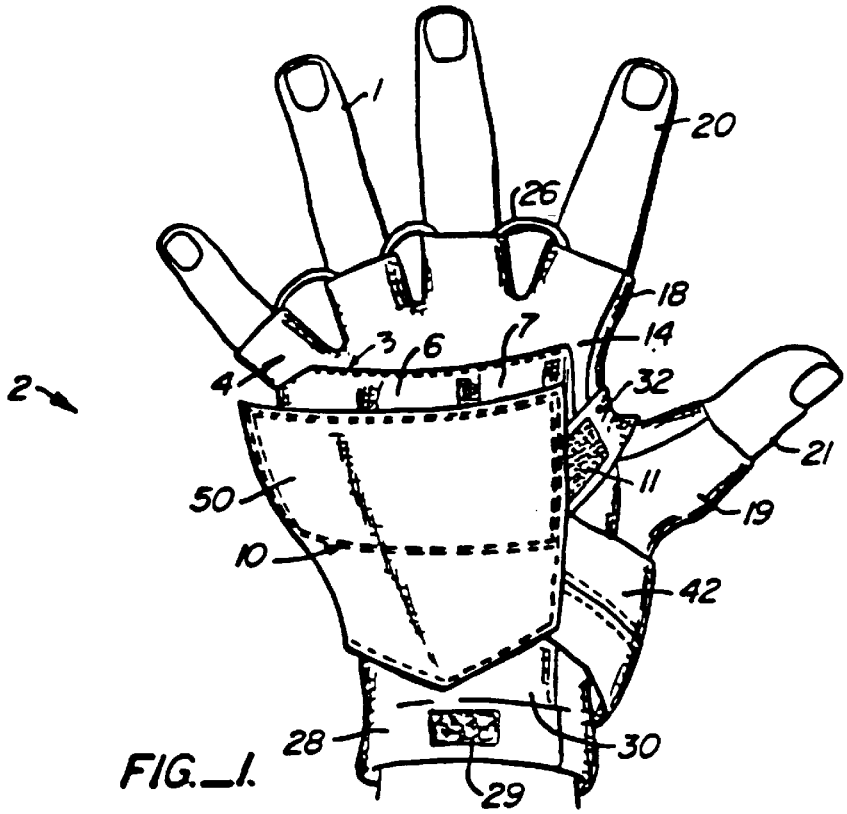
FIG. 1 is a backhand perspective view of a weighted and gloved exercise apparatus intended for terrestrial use on a user's hand.

Referring now to the drawings, the various embodiments of the invention will now be described. For the sake of convenience and presentation, these embodiments have been sorted into three major groups: I. Weighted Gloveless Exercise Apparatus; II. Gloved Exercise Apparatus; and III. Glove having quick removal means. This subdivision of the Detailed Description is not intended to convey any fundamental principal or aspect of the invention that is not otherwise explicit, nor should it.

With regard to the Figures, it will be understood that the present invention is generally used in pairs, having a left hand apparatus and right hand apparatus; that for illustrative purposes a glove type was chosen; and although not illustrated every glove type has a match that is a mirror image of the various embodiments shown in the drawings.

I. Weighted Gloveless Exercise Apparatus

Figure 5:
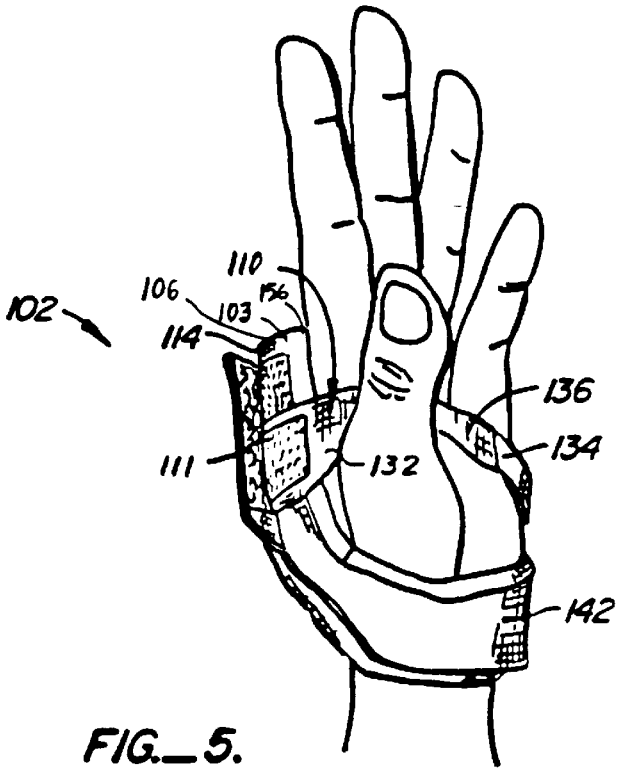
FIG. 5 is a side palm perspective view of a hand-adapted, gloveless, weighted embodiment of the exercise apparatus of the invention.
Figure 53:
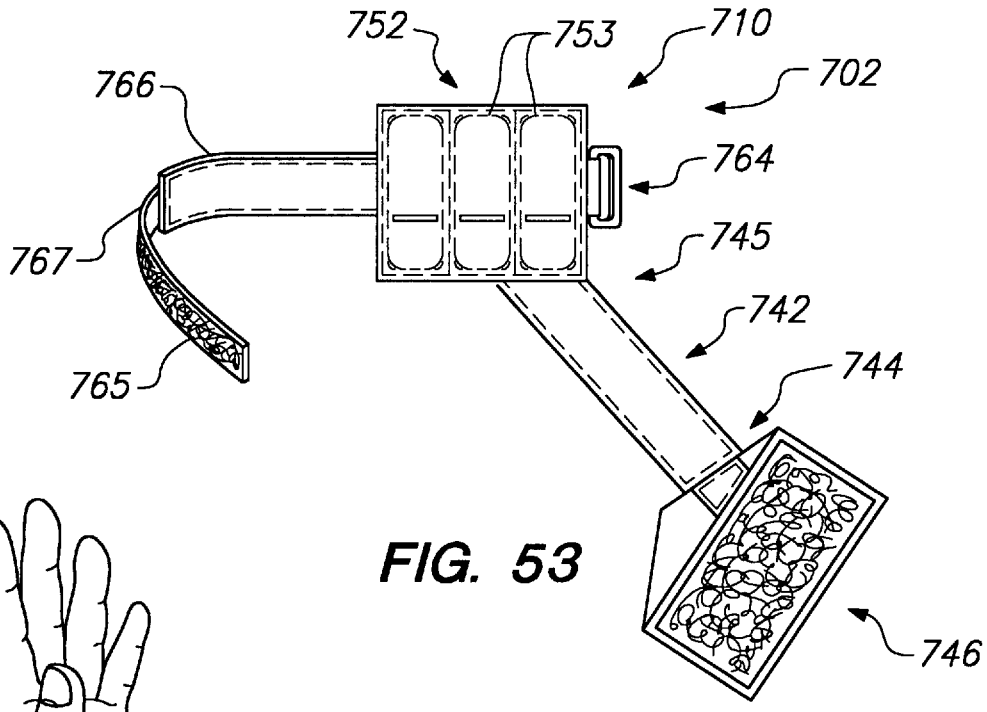
FIG. 53 is spread view of a second embodiment of the gloveless, weighted exercise apparatus of the invention in a non-attached, non-aligned configuration using a strap and ring closure.
Figure 54:
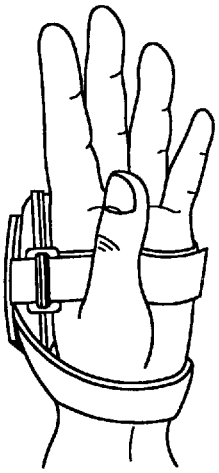
FIG. 54 is a side view of the embodiment of FIG. 53 as it appears when operatively attached and aligned to a user's hand.

According to one aspect of the invention, a gloveless exercise apparatus for variable and adjustable retention of weights on the backhand of a user is illustrated in FIGS. 5, 53, and 54.

Figure 11:
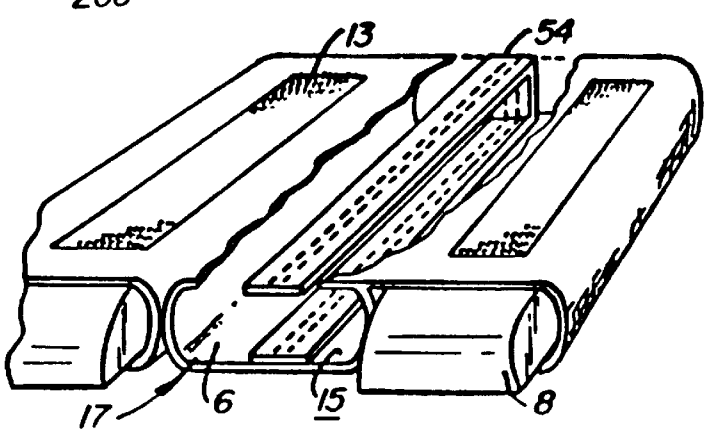
FIG. 11 is a perspective view of the reinforcing strip of the exercise apparatus of the invention in an alternative embodiment.

In an embodiment described in the parent of the present application and shown herein as FIG. 5, the exercise apparatus 102 comprises a support 103 having an insert pocket 106 for receiving a removable weight. Support 103 comprises a backhand portion 114 having pockets 106 formed on a first surface 156. The exercise apparatus is further provided with a strap 110 which overlies pocket 106, and is attached to backhand portion 114. Strap 110 includes a first band 132 having first and second free ends 134, 136 extending around the user's palm for securing strap 110 in place and preventing lateral or perpendicular movement of weights 8. First free end 134 wraps around the metacarpal bone of the little finger. Second free end 136 wraps between the metacarpal bones of the index finger and thumb. Exercise apparatus 102 may further include a re-enforcing strip 154 as seen in FIG. 11.

A second embodiment of the gloveless exercise apparatus of the invention is shown in FIGS. 53 and 54. In this embodiment, the exercise apparatus 702 may comprise a pad 752 that is connected to an auxiliary band 742 at a first end 745 and to a pad 746 at a second end 744. Pad 752 is provided with a pad pocket 753, in which must one or more weights may be removably inserted. Auxiliary band 742 is configured to terminate substantially medially upon the pad 752. Lateral to the point of attachment of the auxiliary band, pad 752 is further provided with a first lateral side 760 and a second lateral side 762. Connected along the margin of first lateral side 760 is a ring closure 764. A strap 766 is attached to the second side 762 of pad 752, at a point substantially opposite the attachment of the ring closure 764 relative to the position of attachment of auxiliary band 742. Strap 766 is further provided with a Velcro strip 765 and a mating strip 767, thereby allowing strap 766 to be threaded through a ring closure 764 and securely mated with itself for securing the exercise apparatus 702 to the hand in a comfortable but stable manner.

The gloveless exercise apparatus described above may be constructed of any suitable material that is both comfortable to the user's skin and is durable under the conditions of a particular exercise regimen, such as leather or natural or synthetic fabrics.

II. Gloved Exercise Apparatus

Also contemplated by the invention is a gloved exercise apparatus for terrestrial and aquatic environments in which a glove or mitt is provided to carry comfortably and non-obtrusively on a user's hand a variably adjustable, amount of weight in order to increase gravitational resistance experienced by a particular muscle or muscle group. In terrestrial environments, the basic glove design is configured to have finger sleeves free from each other. In aquatic environments, the glove is preferentially, but not essentially, provided with webbing between adjacent finger sleeves.

A. Terrestrial Exercise Embodiments

A first embodiment of such an exercise apparatus for terrestrial use is illustrated FIGS. 1–4. Here, support 3 of the gloveless embodiments takes the form of a glove or mitt 4 and includes a backhand portion 14 and palm portion 16. Finger sleeves 18 for receiving the user's fingers 20 are formed integrally with mitt 4, between backhand portion 14 and palm portion 16. It is noted that while the embodiment illustrated in FIGS. 1–3 includes a thumb sleeve 19, the thumb sleeve is not necessary to practice the present invention.

A plurality of pockets 6 are juxtaposed and mounted to backhand portion 14 of mitt 4 for placement of exercise apparatus 2 on the back of the metacarpal area of the user's hand. Pockets 6 are aligned parallel to finger sleeves 18. Weights 8 may be inserted into or removed from pockets 6 through opening 17. Therefore, as weights 8 are inserted into pockets 6, they assume an orientation parallel to the user's fingers 20. This orientation optimizes muscle group movement, minimizes restriction of blood flow, and also permits weights 8 to conform to the natural curvature of the back of the hand. Velcro strips 13, mounted to an outer surface 7 of pockets 6, are parallel to each other and to finger sleeves 18.

Figure 3:
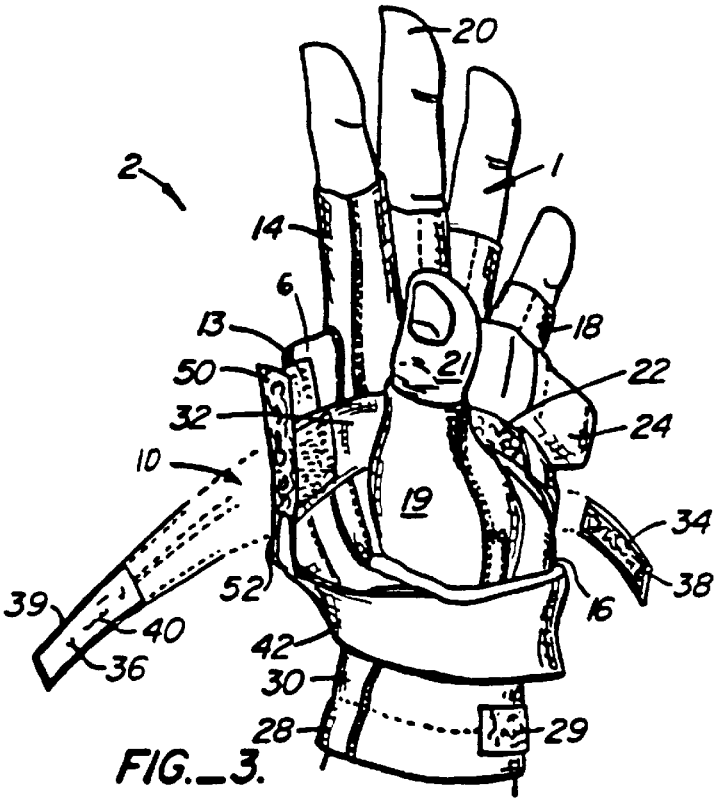
FIG. 3 is a side palm perspective view of the invention as shown in FIG. 1.
Figure 4:
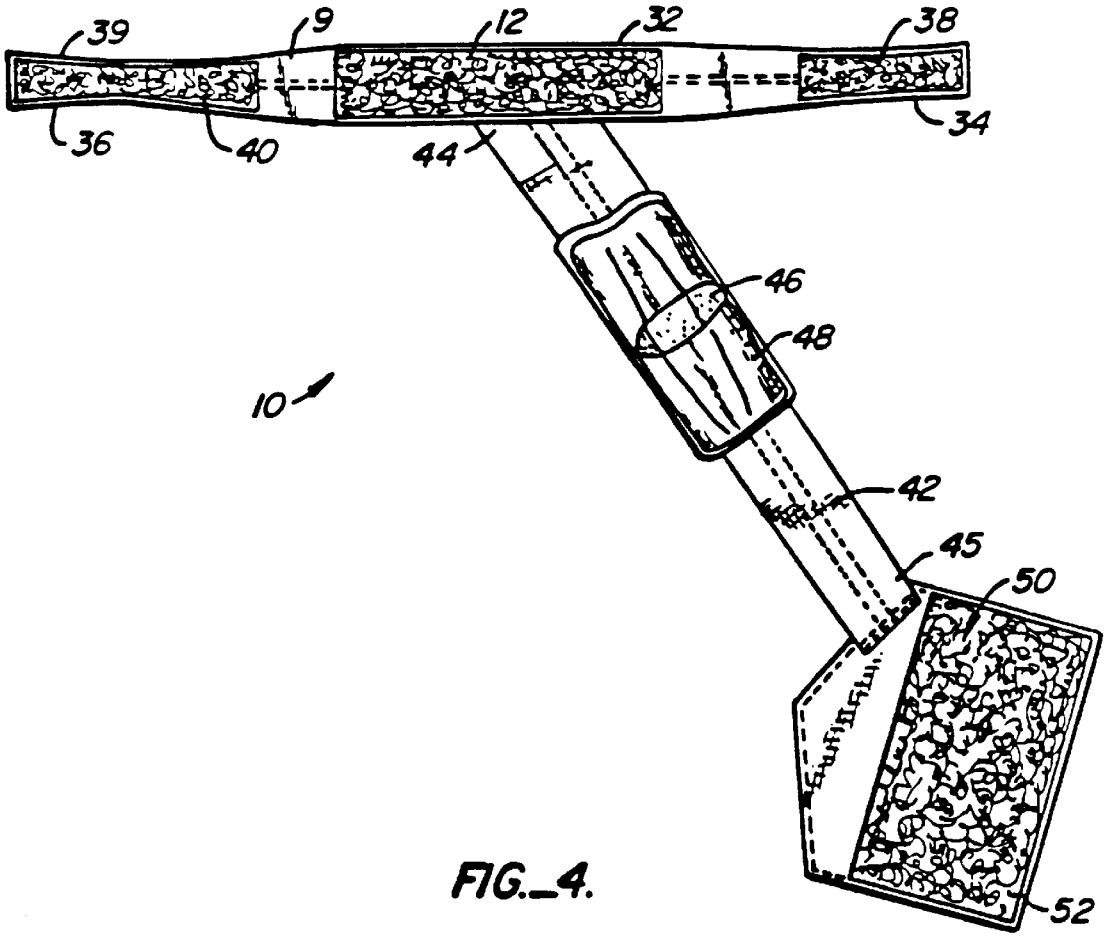
FIG. 4 is an underside view of the strap of the embodiment of the gloved exercise apparatus of FIG. 1.

Palm portion 16 of mitt 4, as seen in FIG. 3, includes a Velcro strip 22, for securing strap 10 in place and preventing lateral movement of weights 8. Palm pocket 24 may be mounted in the upper region of palm portion 16 for receiving a palm weight. The user may conform his fingers about the palm weight because it may be comfortable to do so while running, or during other activities. A wrist belt 28 is disposed at the lower end 30 of mitt 4 and includes Velcro fasteners (not shown) for securing exercise apparatus 2 on the user's hand 1.

Strap 10 is removably mounted across pockets 6 by Velcro strips 12, 13 to overly and retain weights 8 in place on the back of the metacarpal area of the user's hand, as seen in FIG. 1. Strap 10 includes a first band 32 having first and second free ends 34, 36 extending around the user's palm for securing strap 10 in place and preventing lateral or perpendicular movement of weights 8. First free end 34 wraps around the metacarpal bone of the little finger. Second free end 36 wraps between the metacarpal bones of the index finger and thumb.

An auxiliary band 42 extends at an angle of approximately 45 from first band 32, downwardly away from finger sleeves 18 toward the user's wrist. An end 44 of auxiliary band 42 is secured to first band 32 along its midsection, toward one side of Velcro strip 12 closer to the little finger. A patch 50 is attached to an end 45 of auxiliary band 42, opposite end 44. Auxiliary band 42 extends across backhand portion 14 downwardly away from fingers 20, and encircles the inside of the user's wrist, then below thumb 21, such that patch 50 can be secured to first band 32 across the metacarpal area of the backhand. The large configuration of patch 50 allows for maximal adjustment of exercise apparatus 2, as well as to fasten patch 50 simultaneously to both Velcro strips 12,13.

A pad 46 may be positioned in a pad pocket 48 on underside 9 of auxiliary band 42 at a location resting on the user's wrist. Pad 46 ensures maximum comfort by decreasing the force pressure operating against the palmaris longus tendon of the user's wrist, or the band may be elastic.

Free ends 34, 36 converge at palm portion 16 and are secured together by Velcro strips 38, 39. Velcro strip 38 is disposed on underside 9 at first free end 34. Velcro strip 39 is disposed on free end 36 on the outer surface of strap 10 for mating with Velcro strip 38. In the embodiment of strap 10 shown in FIG. 4, second free end 36 is wrapped around the user's hand prior to wrapping first free end 34. A Velcro strip 40 is disposed on underside 9 of free end 36 mating with Velcro strip 22 of palm portion 16. Patch 50 includes Velcro 52 mounted on underside 9. When auxiliary band 42 is wrapped around the user's wrist, Velcro 52 mates with Velcro strips 13 on outer surface 7 of pockets 6 and with a Velcro strip 11 mounted on the outer surface of strap 10, on the surface of first band 32 opposite Velcro strip 12.

It should be understood that first free end 34 could include Velcro strips on both underside 9 and the outer surface, allowing first free end 34 to be wrapped around the user's hand prior to wrapping second free end 36. Gloved exercise apparatus for terrestrial environments may be constructed of any suitable material that is both comfortable to the user's skin and is durable under the conditions of a particular exercise regimen, such as synthetic or natural fabrics or leather.

Use of exercise apparatus 2 will now be described. The desired amount of weight 8 is placed in insert pockets 6 and palm pocket 24. The user inserts hand 1 into mitt 4 as one would put on a glove. Fingers 20 are located within respective finger sleeves 18. Thumb 21 is located within thumb sleeve 19. Velcro fasteners (not shown) positioned on wrist belt 28 are attached together.

Strap 10 is then fastened to mitt 4 for securing weights 8 in their proper position. Velcro strip 12 on first band 32 is affixed to Velcro strip 13 on pocket 6 of backhand portion 14. Second free end 36 is extended to wrap between the metacarpal bones of the user's index finger and thumb. Velcro strip 40 on underside 9 of second free end 36 is affixed to Velcro strip 22 on palm portion 16. Velcro strip 39 disposed on the outer surface of second free end 36 is exposed for mating with first free end 34. First free end 34 is extended to wrap around the metacarpal bone of the user's little finger such that Velcro strip 38 is affixed to Velcro strip 39. Weights 8 are thereby secured against lateral movement across the back of the user's hand or perpendicular movement away from the user's hand.

Auxiliary band 42 is extended across backhand portion 14, from its position offset to one side closer to the user's little finger. Auxiliary band 42 is wrapped toward the metacarpal bone of the user's little finger and around the inside of the user's wrist. Pad 46, which generally remains stored within pad pocket 48, is positioned about the user's wrist for maximum comfort and to ease pressure on the palmaris longus tendon of the wrist. As end 45 of auxiliary band 42 encircles the user's wrist near thumb 21, patch 50 is brought upwardly around the opponens pollices muscle of the user's thumb 21 such that Velcro 52 is fastened to Velcro strips 11 and 13. First band 32 prevents lateral movement of weights 8. Auxiliary band 42 prevents movement of weights 8 against gravity. In this way, weights 8 are securely fastened to the metacarpus area of the back of the user's hand in both the lateral and gravitational directions. If desired, the wrist weight (not shown) may then be attached to exercise apparatus 2 by Velcro at strip 29.

Turning now to FIG. 11, a reinforcing strip 54 may be affixed to interior surface 15 of pocket 6 for securing weight 8 in place. Re-enforcing strip 54 can be seen through opening 17 in pocket 6. Re-enforcing strip 54 may be a continuous reinforcing element extending along the bottom interior surface of pocket 6 adjacent opening 17, rearwardly (as seen in FIG. 11), around to the upper interior surface of pocket 6 and terminating adjacent the upper interior surface of pocket 6, adjacent opening 17. Reinforcing strip 54 is sewn through interior 15 of pocket 6 and to Velcro strip 14. In this manner, weight 8 is effectively secured because it is encased by strip 54 which is locked to Velcro strip 14 which, itself, locks to Velcro strip 12. Therefore, weight 8 is ultimately secured, through this series of locking mechanisms to the securing strap 10. Reinforcing strip 54, as seen in FIG. 11, may be affixed within the interior of the pockets of any form of the invention disclosed herein. However, the pockets of the present invention could be constructed without a reinforcing strip.

Figure 2:
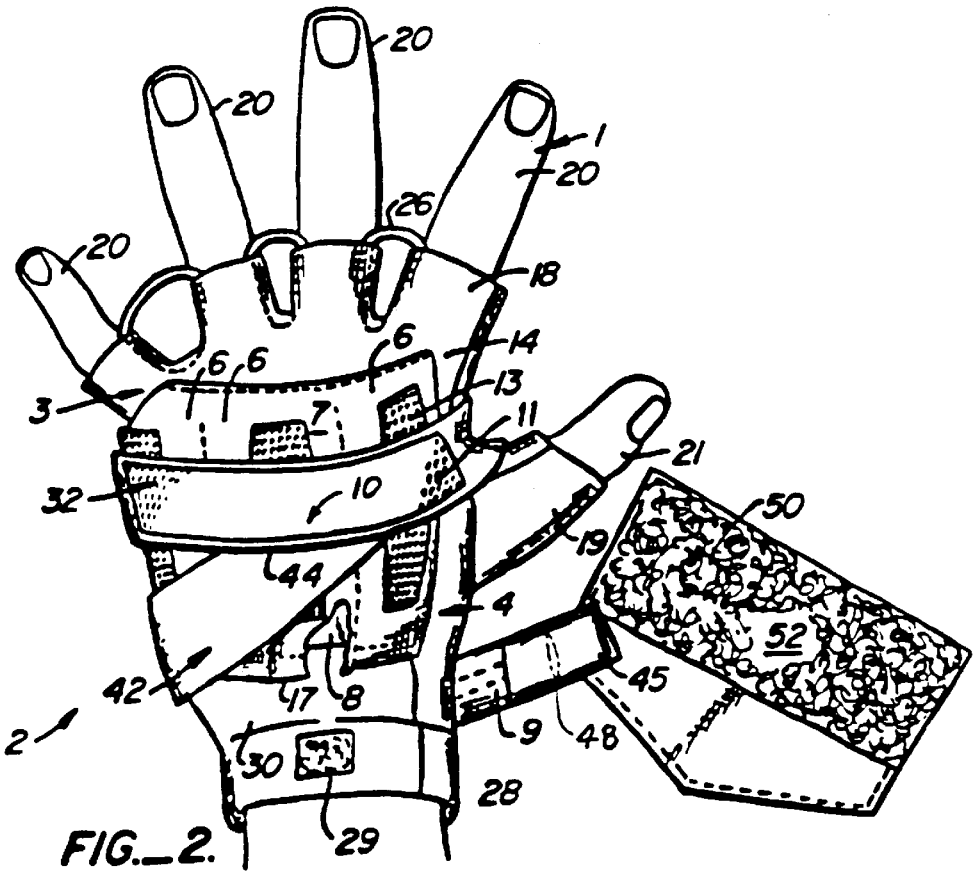
FIG. 2 is a backhand perspective view of the embodiment of FIG. 1 as it is being placed on the user's hand.

The wrist belt 28 includes a Velcro strip 29, as seen in FIGS. 1–3. An additional wrist weight (not shown), preferably in the form of a bracelet, may be added to exercise apparatus 2. The wrist weight is attached to Velcro strip 29 by a corresponding Velcro strip disposed on the wrist weight. A wrist weight may be adapted for any of the embodiments disclosed in this application.

In order to remove exercise apparatus 2 from the user's hand, strap 10 is loosened in reverse manner to that of fastening. The present invention includes an apparatus for facilitating removal of mitt 4 from hand 1. The user inserts the fingers of the opposite hand into loops 26 on the exterior of mitt 4. The user extends each of fingers 20 in mitt 4 to its unbent configuration, then pulls loops 26 with the fingers of the opposite hand. Because loops 26 extend to interior 5 of adjacent finger sleeves 18, 18', mitt 4 is easily removed from hand 1 by pulling on the loops.

B. Amphibious Exercise Embodiments

Figure 6:
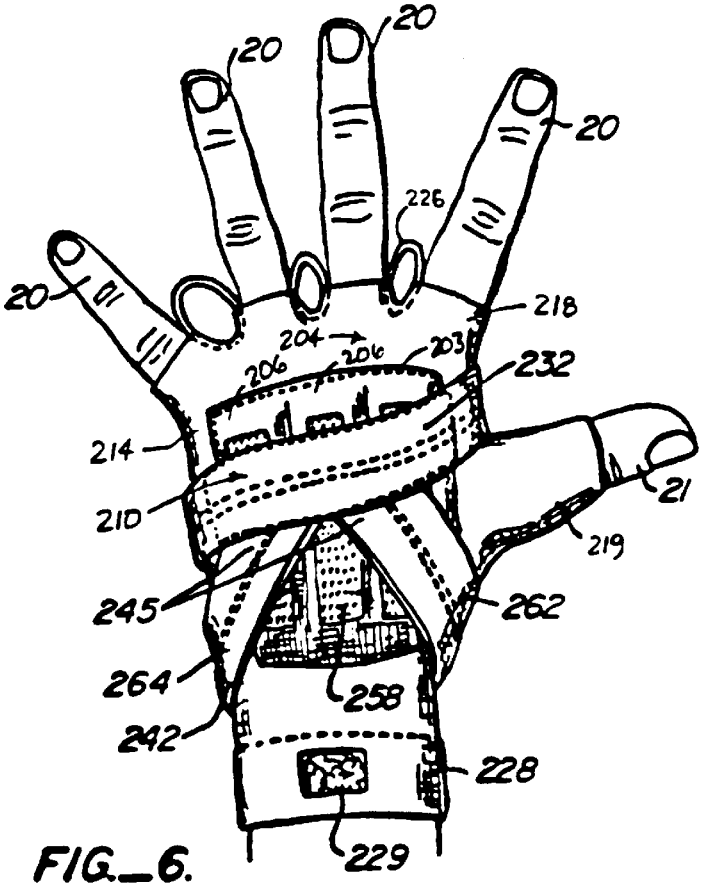
FIG. 6 is a backhand perspective view of embodiment of a gloved, weighted, amphibious exercise apparatus of the invention intended for both terrestrial and aquatic use.
Figure 7:
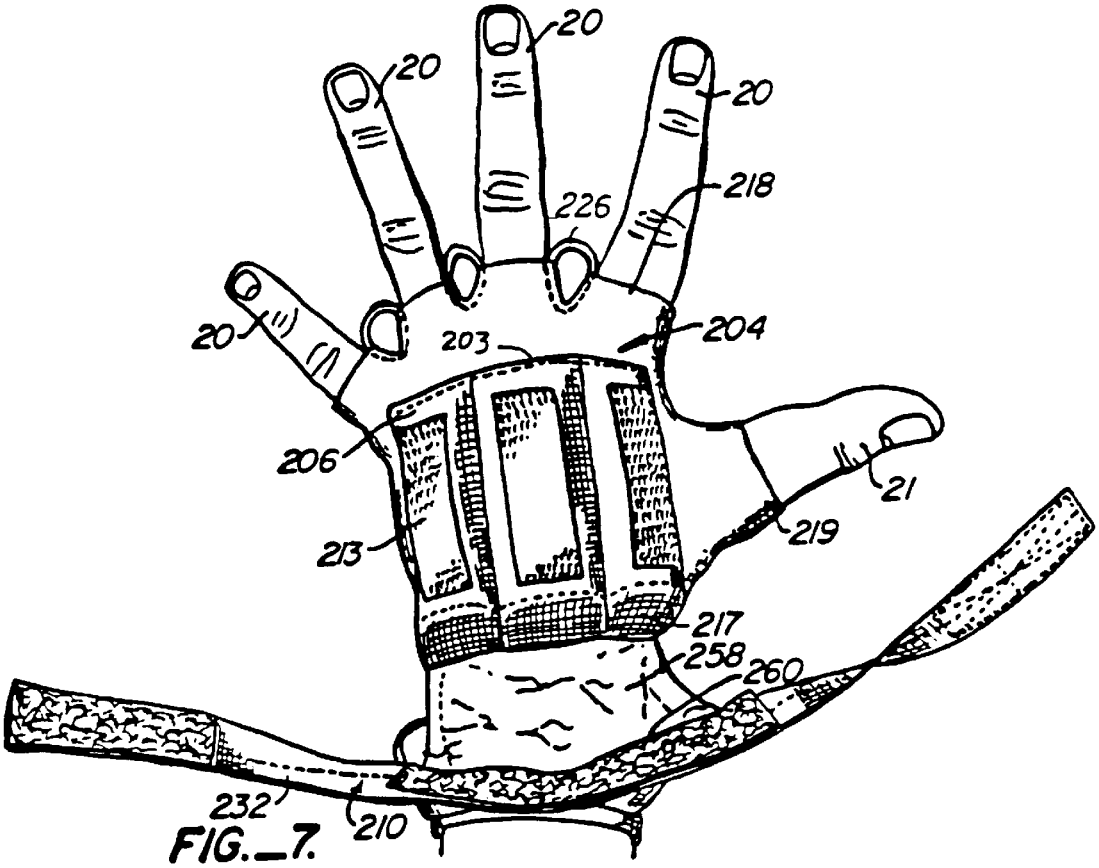
FIG. 7 is a backhand perspective view of the embodiment as shown in FIG. 6 on the user's hand in the unfastened position.
Figure 8:
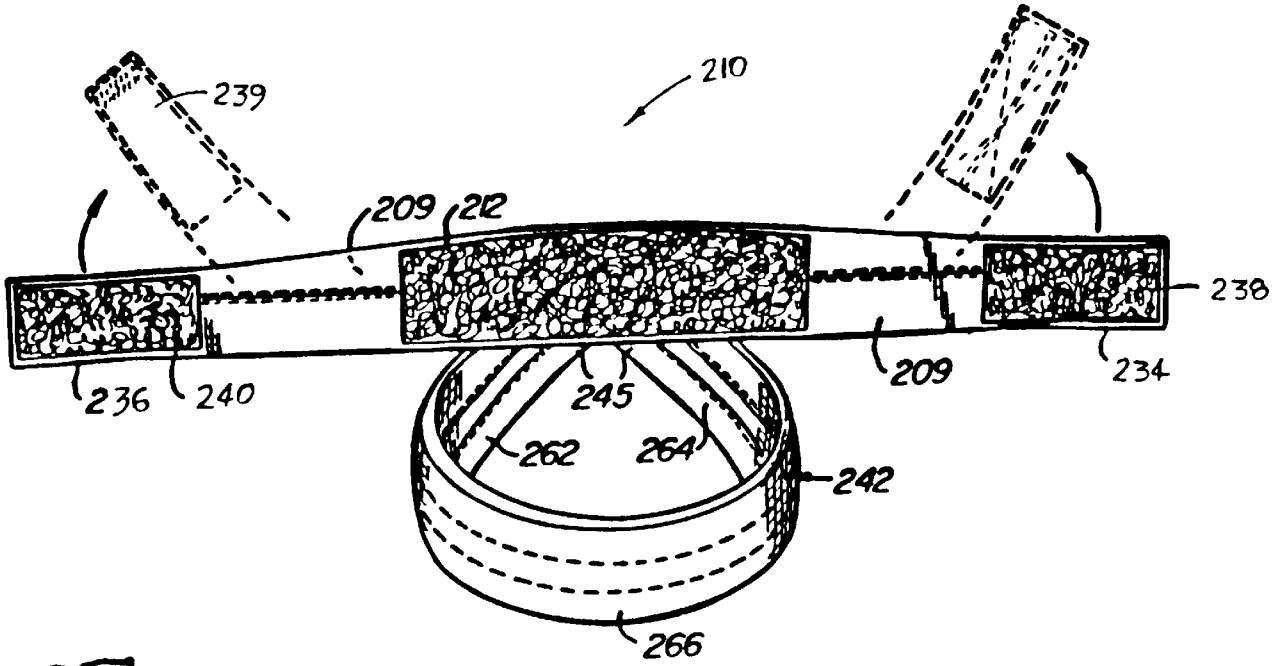
FIG. 8 is an underside view of the strap as shown in FIG. 6 and in the embodiment of FIG. 9.

A gloved, weighted, but unwebbed exercise apparatus suitable for both terrestrial and aquatic exercise is illustrated in FIGS. 6–8. As shown in FIGS. 6 and 7, support 203 is in the form of a mitt 204 having a backhand surface 214 and a palm surface 216. Insert pockets 206 are mounted to backhand portion 214 for receiving a removable weight 8. The embodiment shown in FIGS. 6 and 7 is similar to mitt 4 of the embodiment of FIGS. 1–3. However, the embodiment shown in FIGS. 6–8 does not include a patch which may be susceptible to water pressure exerted beneath it for undesired release of the Velcro fasteners.

The embodiment shown in FIGS. 6–8 differs from the embodiment shown in FIGS. 1–3 in that strap 210 is permanently secured to support 203. Mitt 204 includes a flap 258 for closing pockets 206 containing weights 8. Flap 258 is attached to backhand portion 214 between opening 217 and wrist belt 228. In the open position of flap 258, a remote edge 260 of the flap is suspended toward the user's wrist as seen most clearly in FIG. 7. Strap 210 is attached to flap 258 along remote edge 260. Velcro strip 212 adjoins remote edge 260 for fastening Velcro strip 212 to Velcro strips 213. When Velcro strips 212, 213 are fastened together, flap 258 is retained across the back of the metacarpal area of the user's hand, closing pockets 206.

Strap 210 includes a first band 232 having first and second free ends 234, 236, as described with reference to first and second free ends 34, 36 of FIGS. 1–4. First and second free ends 234, 236 include Velcro, as described above, for securing in mating position on palm portion 216.

An auxiliary band 242 includes two ends 245, both permanently secured to first band 232. Ends 245 extend symmetrically from first band 232, each at an angle of approximately 45, downwardly away from finger sleeves 218 toward wrist belt 228. Auxiliary band 242 extends symmetrically across backhand portion 214, one branch 262 extending about opponens pollices muscle of the user's thumb 21; the other branch 264 extending about the abductor digit quinti muscle at the little finger. Branches 262, 264 unite at union 266 as seen in FIG. 8, encircling the user's wrist. For illustration of union 266 positioned on the user's wrist, refer to the embodiment of FIG. 9, described below.

Strap 210 is specifically designed to maximize laminar water flow by eliminating a patch as seen in the embodiment of FIGS. 1–4. A patch such as patch 50 would peel back in water due to the flow of water against the patch, thereby exposing the patch, increasing water drag and resistance in a manner that is unpredictable and therefore, becomes a hinderance.

Figure 12:
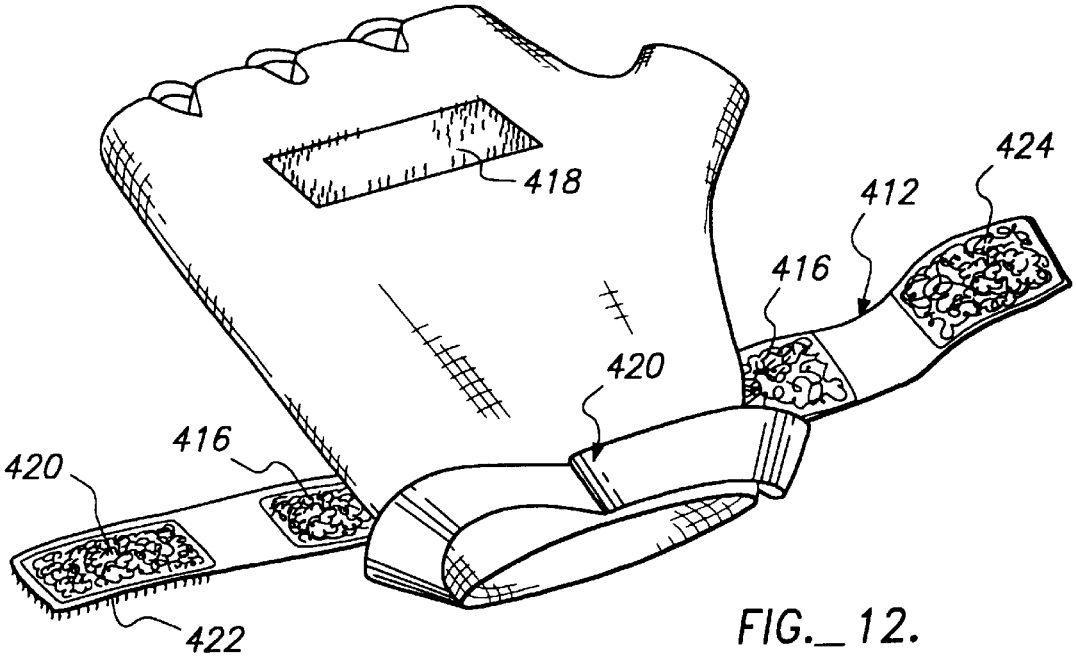
FIG. 12 is a perspective view of the palm side of an alternative embodiment of the gloved, weighted terrestrial exercise apparatus of the invention.
Figure 13:
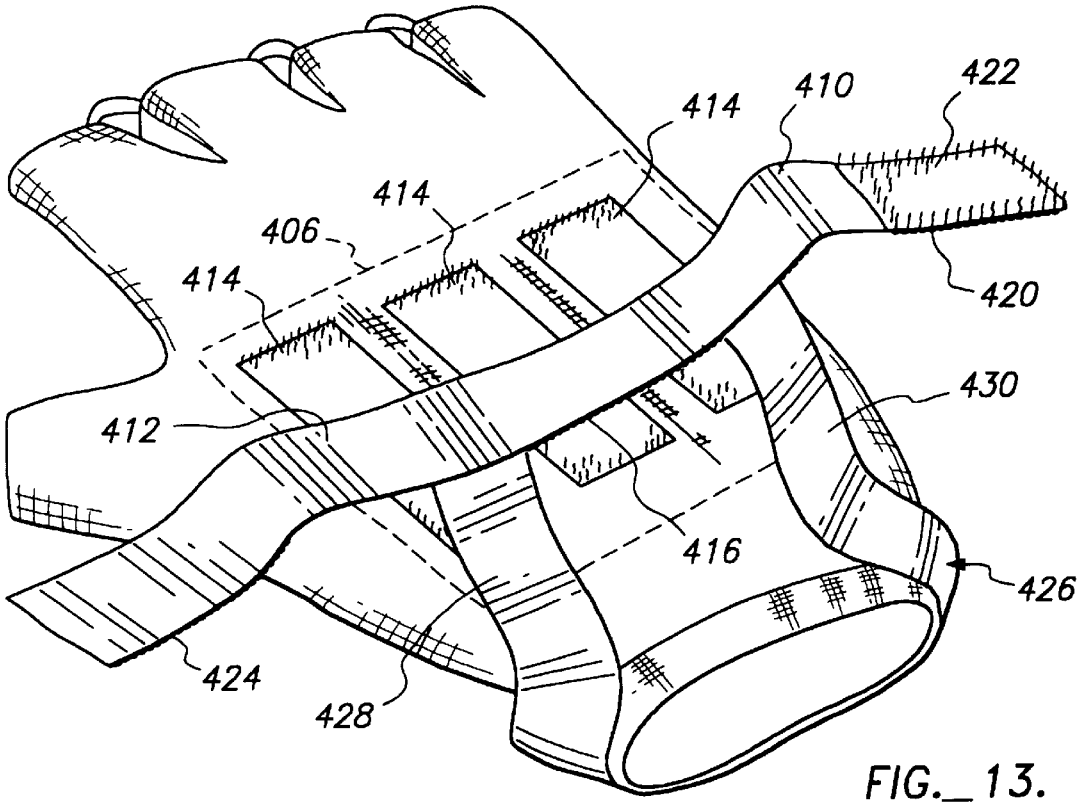
FIG. 13 is a perspective view of the backhand side of the embodiment of FIG. 12.
Figure 14:
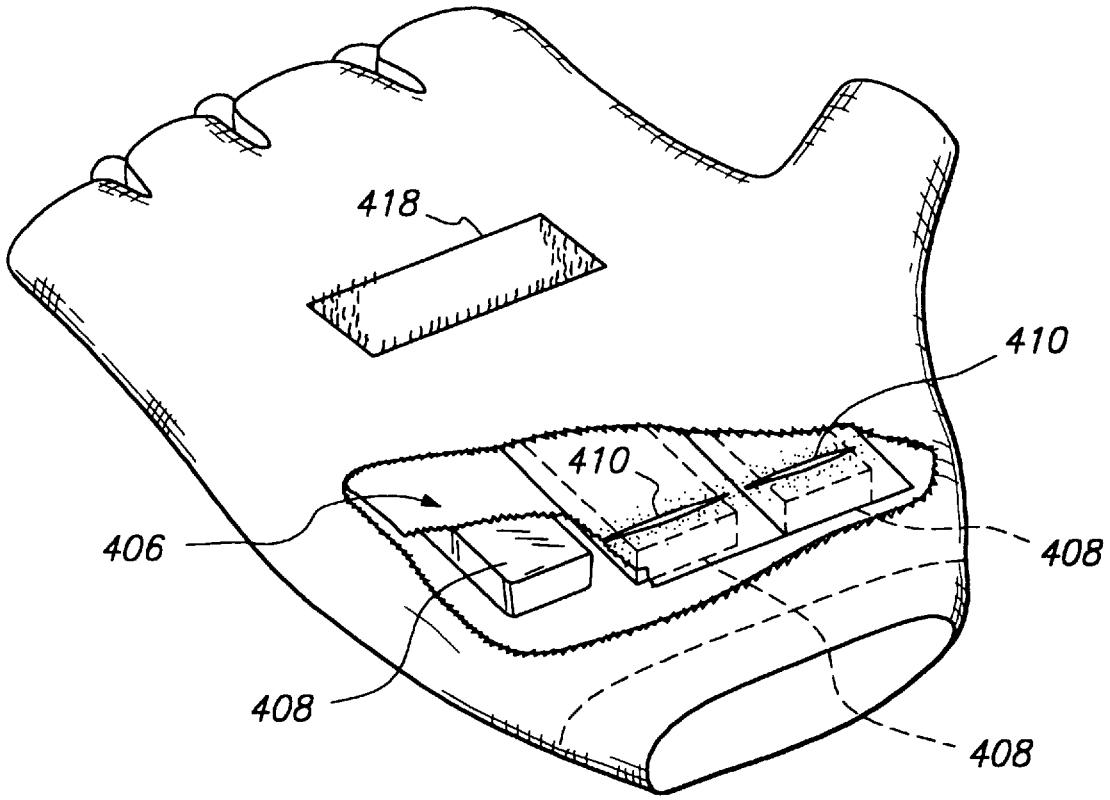
FIG. 14 is a cut-away perspective view of the palm side of the embodiment of FIG. 12 with the strap removed to show the weight pocket.

An alternative embodiment of an amphibious exercise glove according to the invention is shown in FIGS. 12–14 in which the weight pocket is accessible from the inside of the glove mitt. As before, the glove has a mitt, which is generally form fitting to the user's hand, composed of a palm portion visible in FIG. 12 and a backhand portion visible in FIG. 13. Integrally formed with the mitt is a plurality of finger sleeves generally form fitting to the user's fingers. In FIGS. 12–14 the finger sleeves extend to about the mid region of the proximal phalanges of the user's hand, they could extend longer. The backhand portion is formed to include a pocket 406 for receiving a weight. As illustrated in FIG. 13, pocket 406 includes three separate sections for receiving three separate weights 408, although a single weight, or up to three weights, may also be used. As seen in the cut-away view of FIG. 14, pocket 406 opens to the interior of the mitt. The material defining the inner face of the pocket against the user's backhand includes three slits 410 through which weights 408 may be inserted into pocket 406.

If the mitt is formed to fit the user's hand snugly, that is, to fit closely or to form fit the user's hand, then the mitt itself will tend to hold the weight in position against the back of the hand during exercise. The holding action, and the comfort to the user, are enhanced if the mitt is formed of a stretchable material. For light weights and light exercise, this may be sufficient to maintain the weight in position. For more sureness this embodiment may also be provided with a strap 412 over the weight pocket to hold the weights securely against the hand.

To hold strap 412 in position over the weight pocket, the backhand portion includes a first hook and loop fastener portion 414 overlying the pocket, and strap 412 includes a second hook and loop fastener portion 416 of opposite character over said pocket disposed to connect with the fastener portion 414. Strap 412 extends around the mitt to the palm portion where it attaches to itself and to the palm portion. For this purpose the palm portion carries hook and loop fastener portion 418, and one end of strap 412 includes mating hook and loop fastener portion 420. The opposite ends of strap 412 also carry further hook and loop fastener portions 422 and 424 connecting to one another to fasten the strap ends securely to each other.

Strap 412 holds the weight securely against relative movement transverse to the user's hand during exercise. An auxiliary strap 426 may also be employed for extra security in holding the weight against relative longitudinal movement outward along the axis of the user's hand. As illustrated in FIG. 12, strap 426 is connected to the exercise glove at the mid region indicated at reference numeral 428 on the palm side, although the auxiliary strap may also be wrapped round the wrist or attached at other locations. Auxiliary strap 426 includes first and second arms 428 and 430 extending around opposite sides of the user's hand to the backhand portion, the arms being connected to strap 412 generally over pocket 406. Auxiliary strap 426 serves to exert a tension on the main strap 412 in the direction along the user's arm, which serves to hold the weight fixed in position during exercise movements in which the arm, and consequently weight 408, are thrown forward or simply dropped to the user's side.

C. Aquatic Exercise Embodiments

Figure 9:
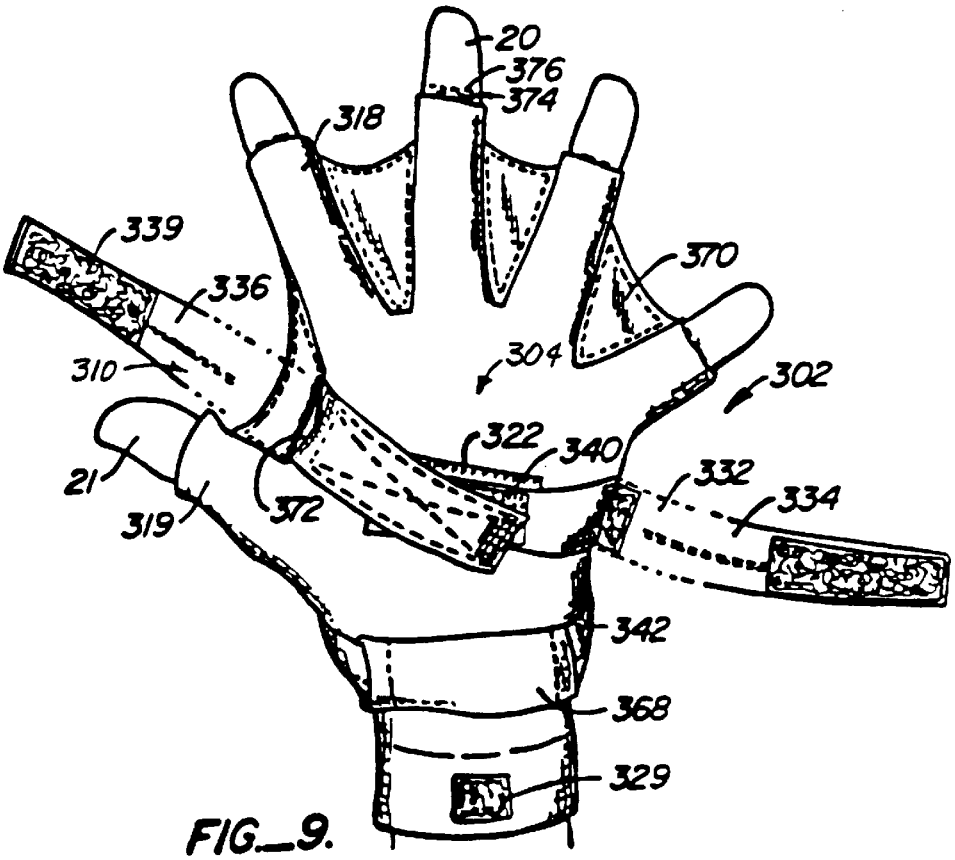
FIG. 9 is a palm perspective view of a first embodiment of a gloved, weighted aquatic exercise apparatus of the invention.
Figure 46C:
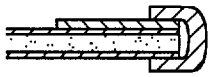
FIG. 46A is a view of a marginally disposed elastic support embodiment of the wrist securing means of the invention.
FIG. 46B is a view in cross section of a portion of the wrist band.
Figure 46A:
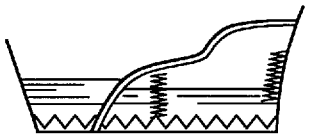
Figure 46B:
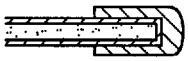
Figure 47A:
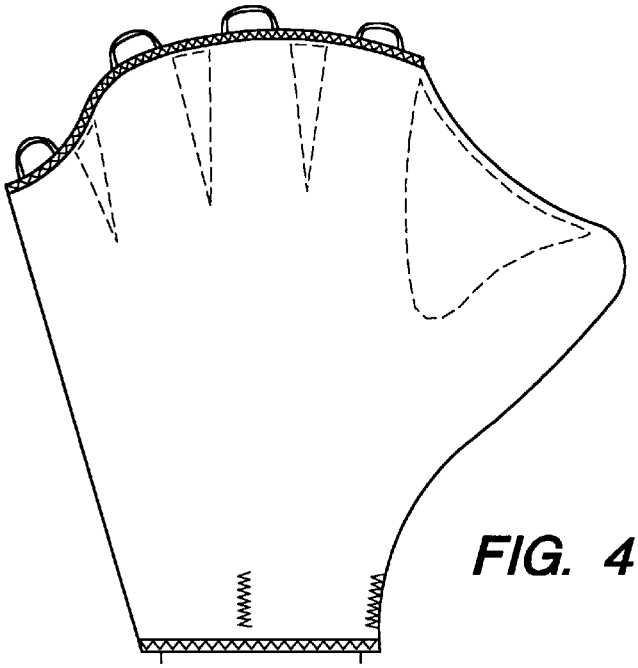
FIG. 47A is a backhand view of a embodiment of the webbed but non-weighted aquatic exercise apparatus of the invention.
Figure 47B:
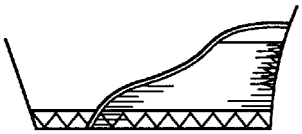
FIG. 47B is a partial cut away of the embodiment shown in FIG. 47A showing an internally disposed elastic support embodiment of the wrist securing means of the invention
Figure 47C:
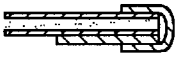
FIG. 47C is a view in cross section of the view in FIG. 47B
Figure 48:
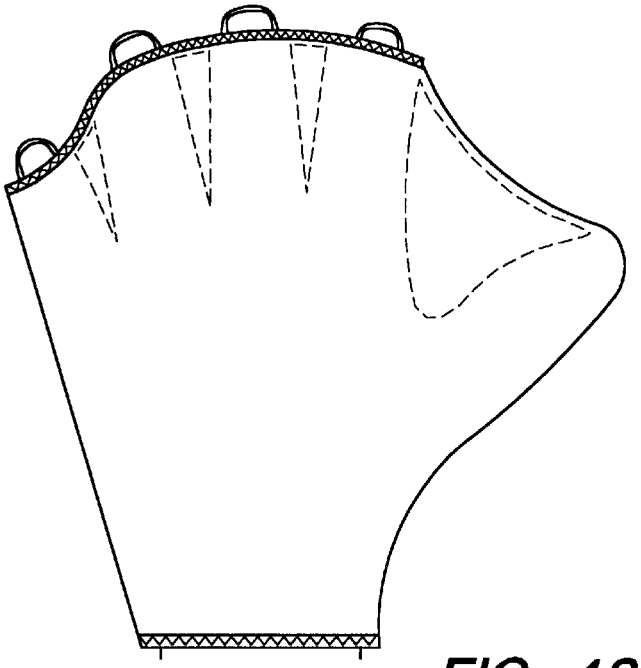
FIG. 48 is a backhand view of a second embodiment of the webbed but non-weighted aquatic exercise apparatus of the invention FIG. 47A in which the wrist securing means has been removed.
Figure 49A:
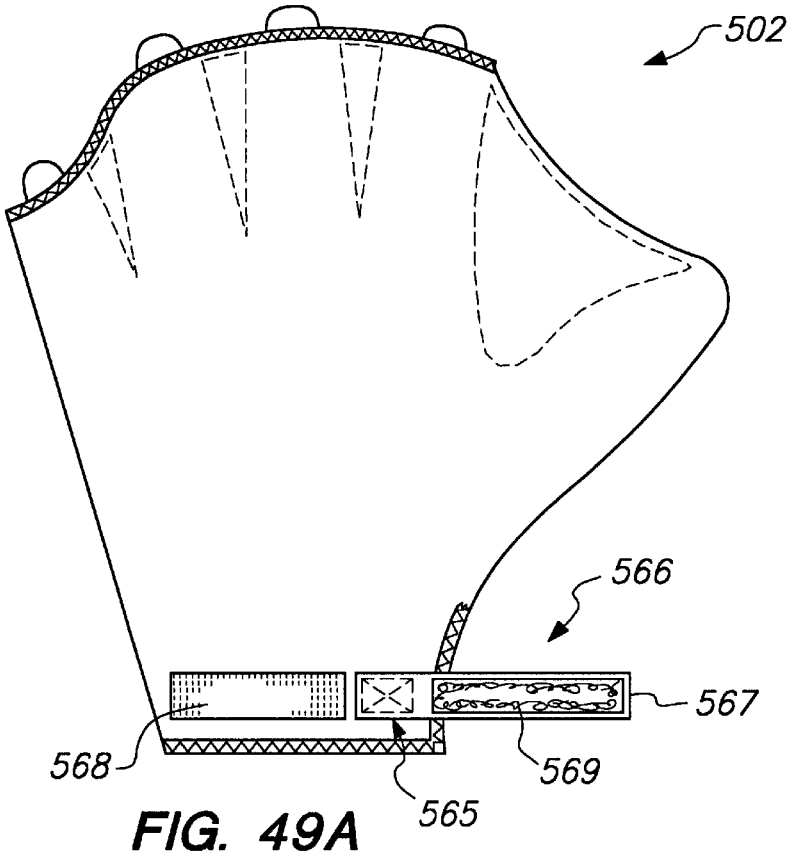
FIG. 49A is a palm view of a third embodiment of the webbed but non-weighted aquatic exercise apparatus of the invention in which the wrist securing means comprises a strap in combination with a ring closure.
Figure 49B:
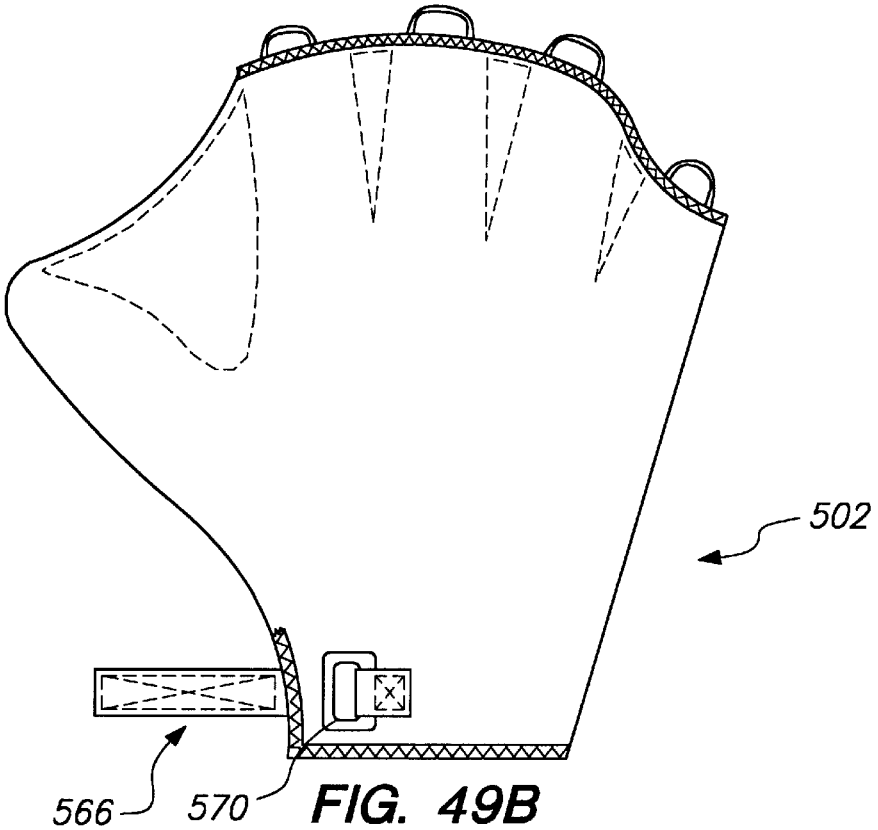
FIG. 49B is a backhand view of the embodiment illustrated in FIG. 49A.
Figure 50:
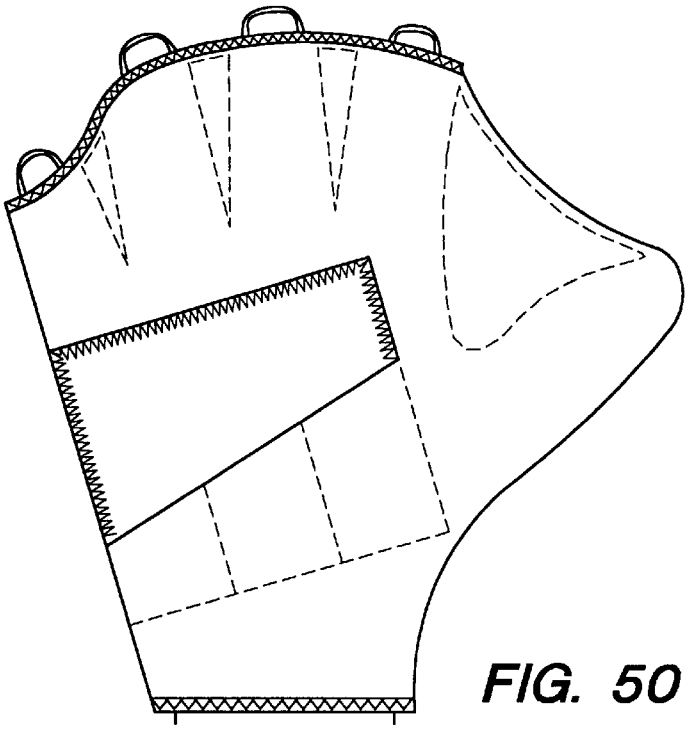
FIG. 50 is a backhand view of a sixth embodiment of the webbed and weighted aquatic exercise apparatus of the invention provided with a fixed position weight flap.
Figure 52C:
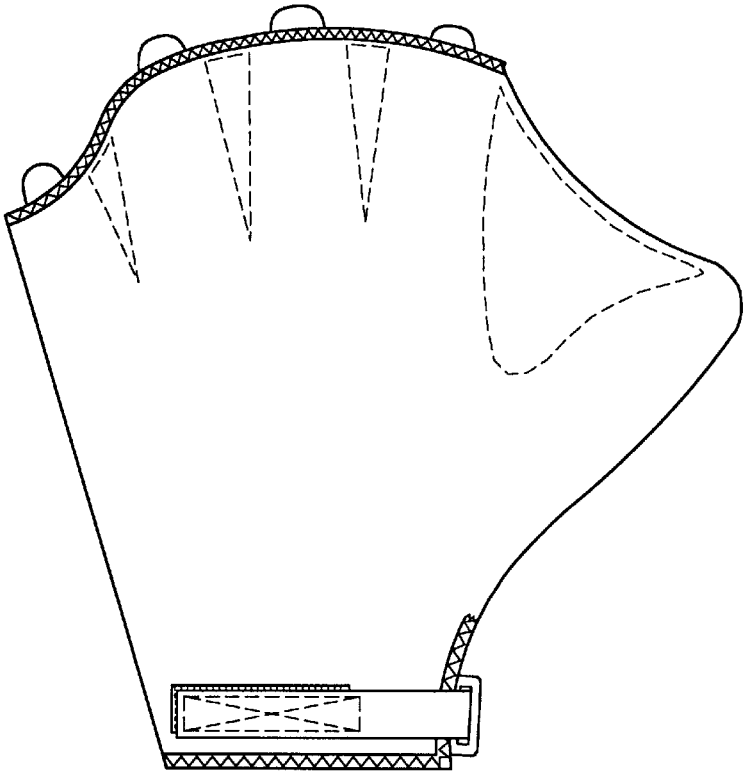
FIG. 52C is a view of the embodiment of FIG. 52A with strap and ring closure in a fastened configuration.
Figure 51:
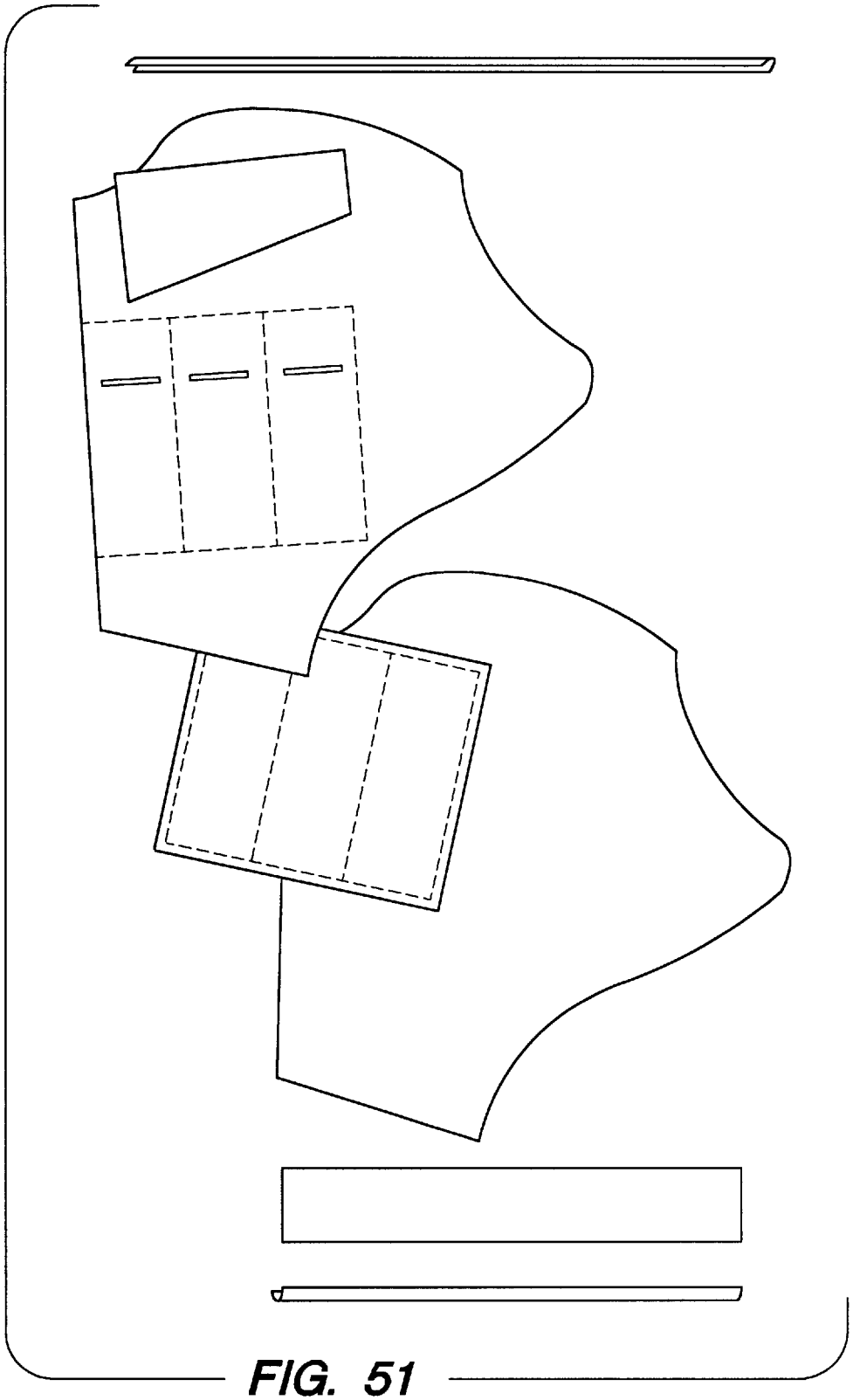
FIG. 51 is an exploded view of the embodiment of FIG. 50.
Figure 52A:
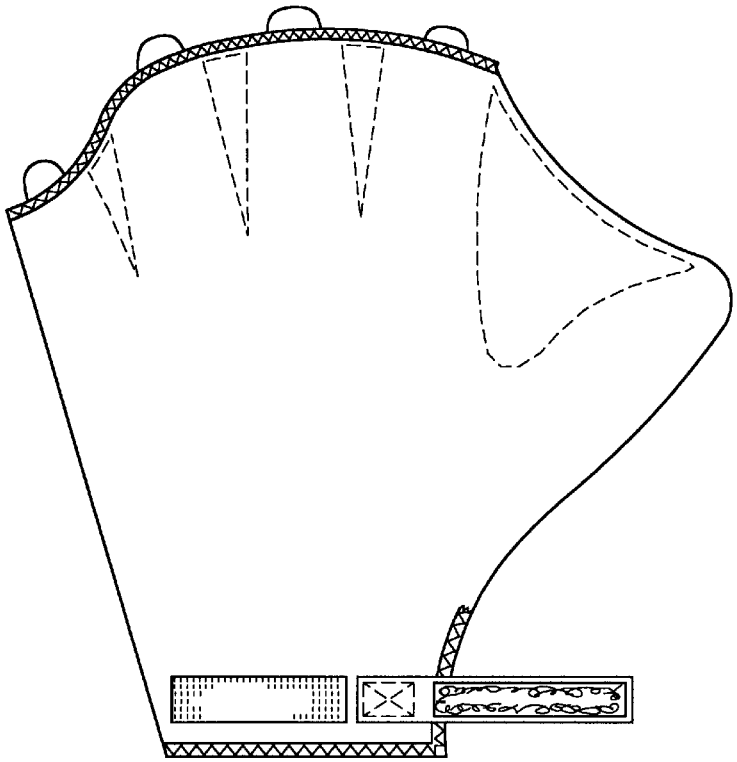
FIG. 52A is a palm view of a variation of the embodiment of the webbed and weighted exercise apparatus shown in FIG. 50 in which the elastic support embodiment of the wrist securing means has been replaced by a strap and ring closure embodiment in a non-fastened configuration.
Figure 52B:
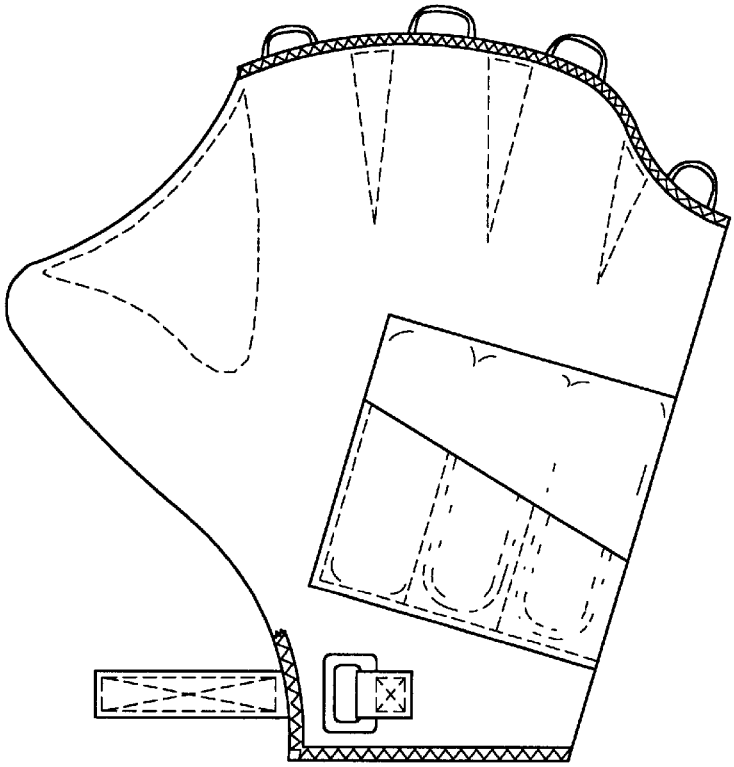
FIG. 52B is a backhand view of the embodiment of FIG. 52A.
Figure 55:
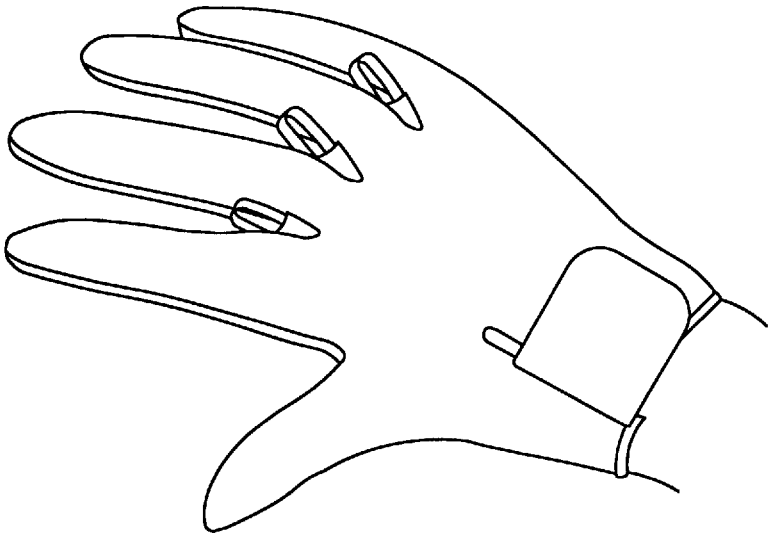
FIG. 55 is a full-fingered variation of the quick removal glove embodiment shown in FIG. 15.
Figure 56:
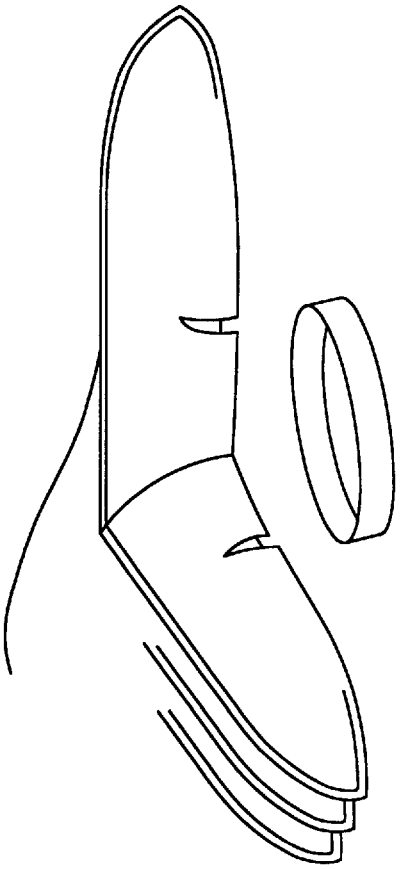
FIG. 56 is a view in perspective of the finger sleeves of the embodiment of FIG. 55, showing the slits on the backhand portion of the finger sleeves for receipt of a loop.
Figure 57:
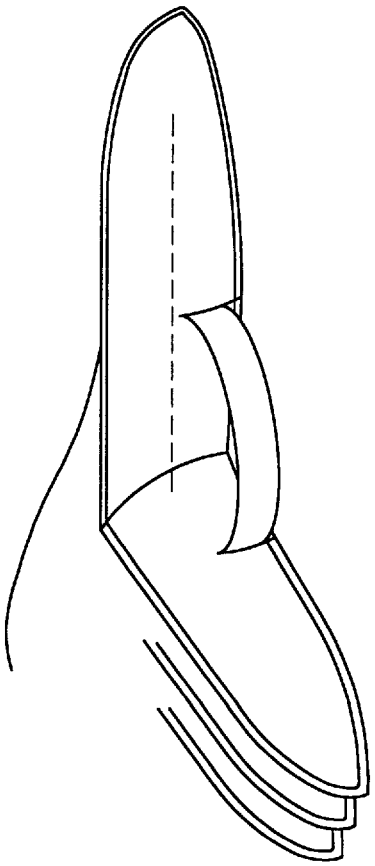
FIG. 57 is a view in perspective of the finger sleeves shown in FIG. 56 with the loop inserted between and made integral with an adjacent pair of finger sleeves.
Figure 58A:
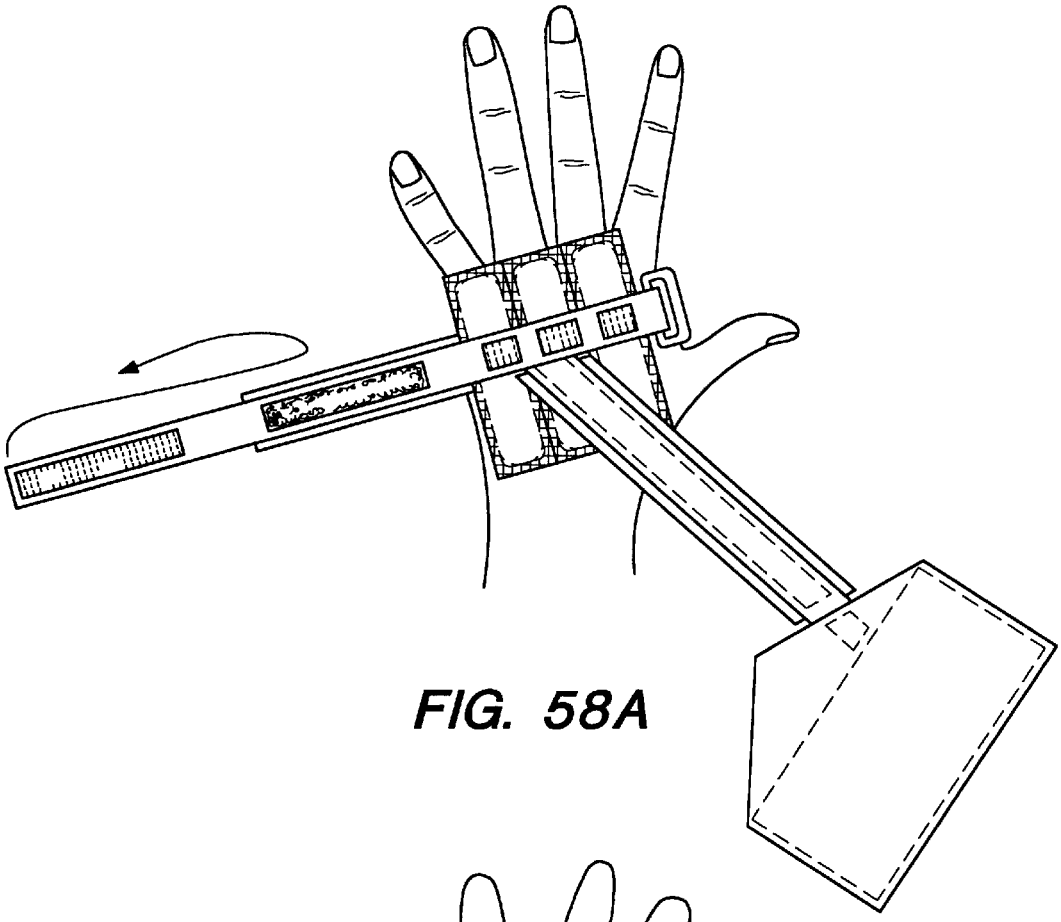
FIG. 58A is a backhand view of the first step in attaching to a hand a second embodiment of the gloveless, weighted exercise apparatus of the invention, showing the weight holders placed on the back of the hand with the weight pockets exposed.
Figure 58B:
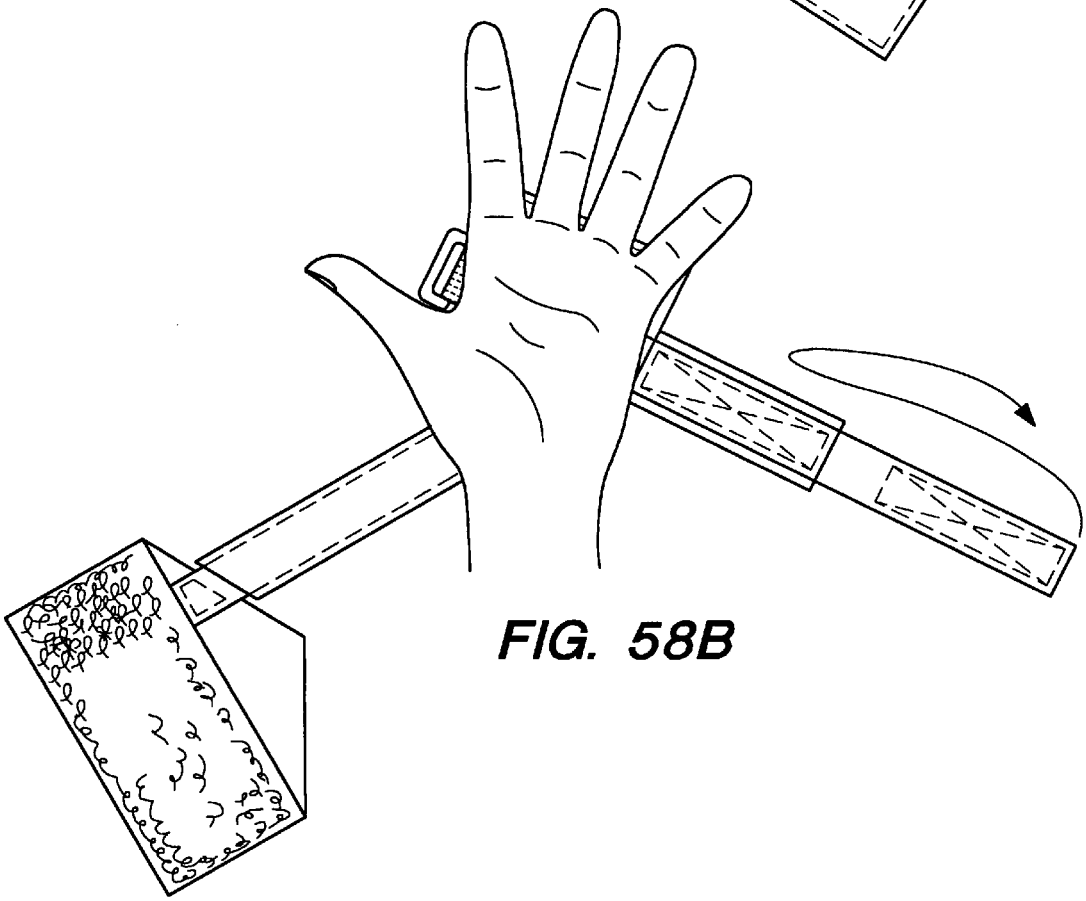
FIG. 58B is a palm view of the first step in attaching to a hand a second embodiment of the gloveless, weighted exercise apparatus of the invention.
Figure 59A:
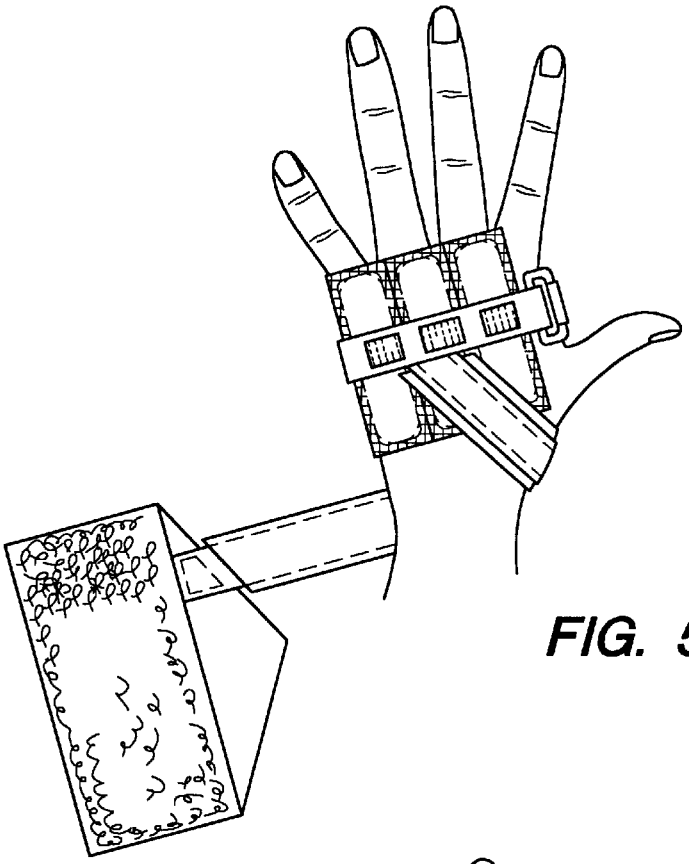
FIG. 59A is a backhand view of the second step in attaching to a hand a second embodiment of the gloveless, weighted exercise apparatus of the invention.
Figure 59B:
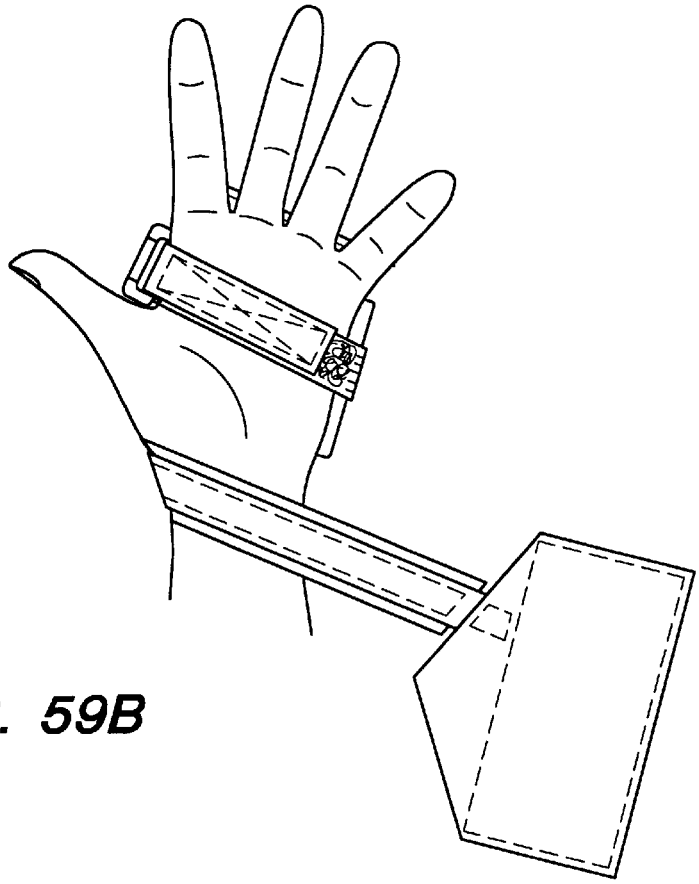
FIG. 59B is a palm view of the second step in attaching to a hand a second embodiment of the gloveless, weighted exercise apparatus of the invention, showing a first strap being thread through the ring and then secured to itself via Velcro surfaces and a second strap half looped around the wrist.
Figure 60A:
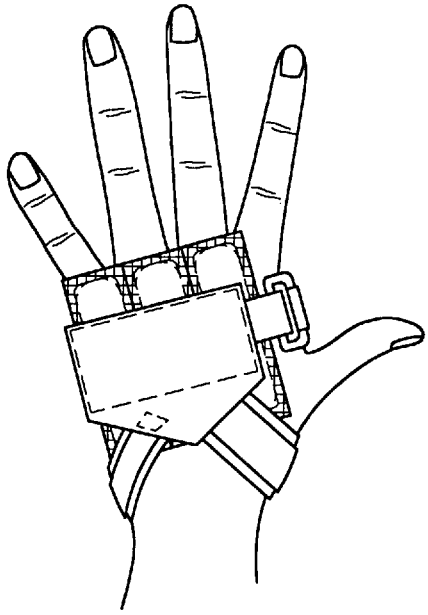
FIG. 60A is a backhand view of the third step in attaching to a hand a second embodiment of the gloveless, weighted exercise apparatus of the invention, showing the second strap being looped around the wrist and secured to the backhand portion via Velcro surfaces.
Figure 60B:
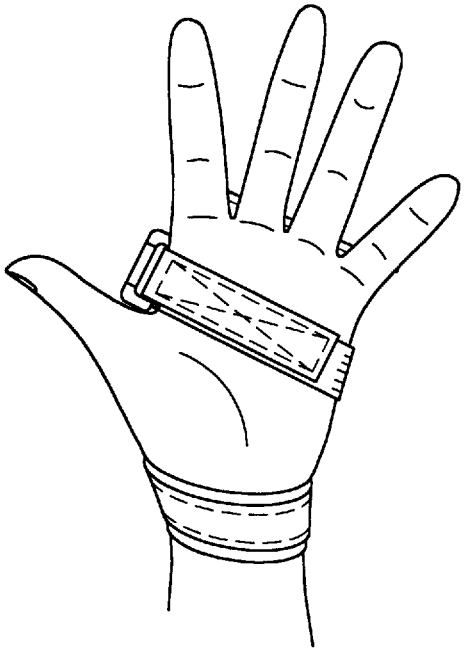
FIG. 60B is a palm view of FIG. 60A.
Figure 62A:
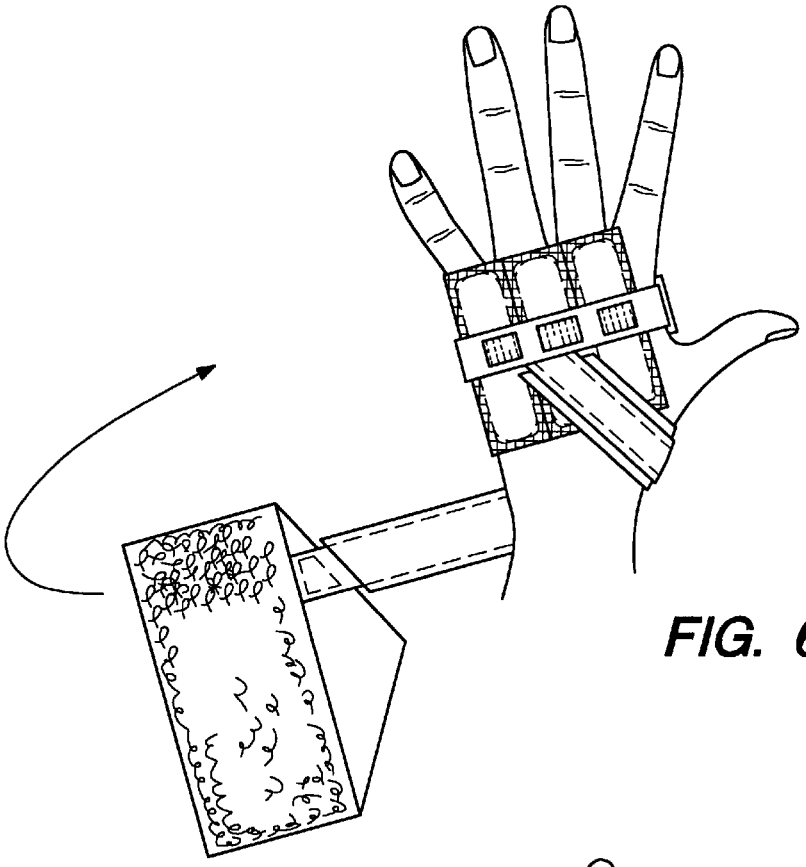
FIG. 62A is a backhand view of the second step in attaching to a hand a second embodiment of the gloveless, weighted exercise apparatus of the invention.
Figure 62B:
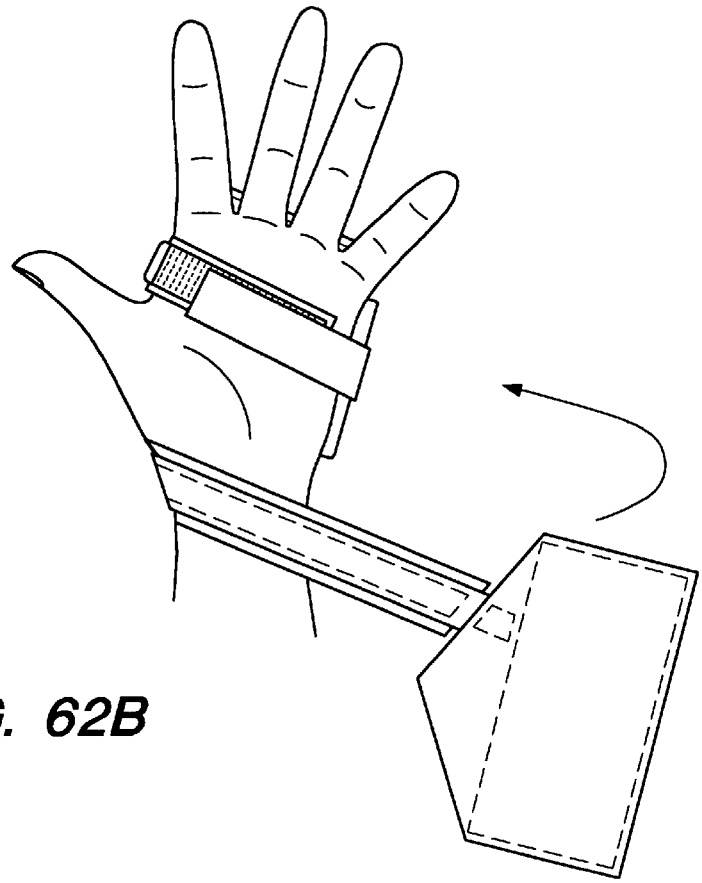
FIG. 62B is a palm view of the second step in attaching to a hand a first embodiment of the gloveless, weighted exercise apparatus of the invention, showing the two straps secured to itself via Velcro surfaces and a second strap half looped around the wrist.
Figure 63A:
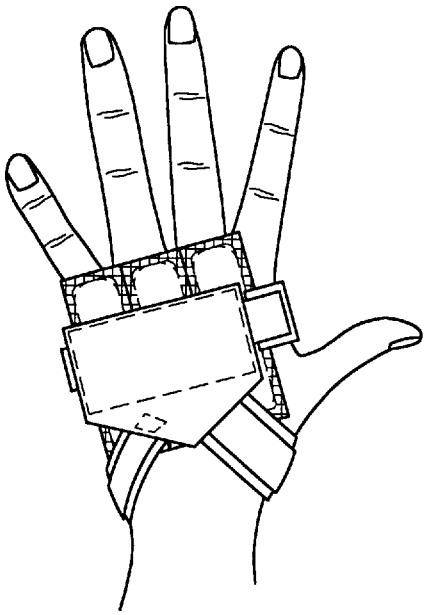
FIG. 63A is a backhand view of the third step in attaching to a hand a first embodiment of the gloveless, weighted exercise apparatus of the invention, showing the second strap being looped around the wrist and secured to the backhand portion via Velcro surfaces.
Figure 63B:
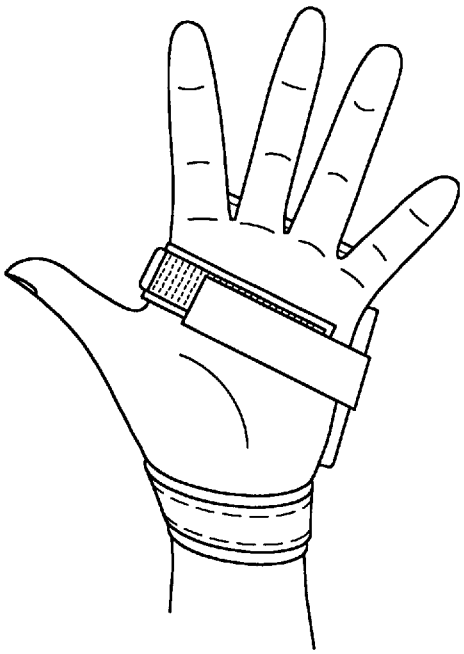
FIG. 63B is a palm view of FIG. 63A.

The three basic embodiment types of gloved exercise apparatus for aquatic environments are described below: (I) weighted and webbed exercise gloves provided with distinct finger sleeves, as illustrated in FIG. 9 ; (II) weighted and webbed exercise gloves provided with finger channels defined by stitching or similar means, as illustrated in FIGS. 33–46 and 50–52; and (III) unweighted, webbed exercise gloves, as shown in FIGS. 47–49.

FIG. 9 discloses a modified form 302 of a gloved exercise apparatus of the invention. Like reference numerals correspond to reference numerals of the embodiment of FIGS. 1–3 incrementally increased by 300. The embodiment disclosed in FIG. 9 is similar to exercise apparatus 202, as seen in FIGS. 6–8, the embodiment illustrated in FIG. 9 is also clearly beneficial for use during swimming.

Strap 310 of FIG. 9 is identical to strap 210 shown in FIG. 8. Branches 362, 364 encircle the user's wrist, uniting at union 366 and fitting within a sleeve 368. It should be noted that strap 210 of exercise apparatus 202 is identical to strap 310, also including a sleeve (not shown in FIGS. 6 and 7).

The aquatic embodiment shown in FIG. 9 differs most significantly from terrestrial embodiments in that adjacent fingers 18 are connected together by webbing 370 to increase the exercise resistance delivered to the user's arms, thus improving efficiency and speed of the swimmer.

As seen in FIG. 9, second free end 336 of first band 332 slips through a slot 372 positioned at the intersection of index finger sleeve 18 and thumb sleeve 19. In this way, second free end 336 wraps between the metacarpal bones of the index finger and thumb, as does the second free end of each of first bands 32, 132, 232.

The webbing of the present invention may be constructed of Neoprene, which neither permits water to pass through nor permits its surface area in contact with the oncoming water pressure to be altered. In this way, the surface area of the webbing is kept maximal and constant, eliminating unnecessary variables previously beyond the swimmer's control.

In use, exercise apparatus 302 operates substantially identically to that of exercise apparatus 202. However, strap 310 of exercise apparatus 302 differs from strap 210 only in that strap 310 slips through slot 372 between finger sleeve 318 and thumb sleeve 319. Additionally, adjacent finger sleeves 318 are connected via webbing 370 (See FIG. 9) rather than loops.

A further embodiment of the aquatic exercise apparatus of the invention is shown in FIGS. 33–46, and 50–52, featuring a backhand weight pocket and webbing. As with the other embodiments, the exercise apparatus 502 is provided with a mitt 504 having a backhand portion 514 and a palm portion 516. Formed within the mitt are a plurality of finger channels 518. Finger channels 518 can be formed in a variety of ways, but are straight forwardly created by stitching, or otherwise affixing together a desired section of the backhand portion 514 with that of palm portion 516 to form finger channels 518 of a desired size and position on the mitt. By similar means, a thumb channel 520 can also be formed. Although the thumb channel 520 and finger channels 518 may be either open or closed, it is generally preferred to construct a mitt in which the thumb channel 520 is closed and the finger channels 518 remain open. In such a case, the overall dimension of the mitt can be configured to extend over a portion of the ultimate segment of each finger, but nevertheless permit the finger tips to project just beyond the edge of the mitt.

The embodiment of the exercise apparatus just described may be fabricated from a wide variety of pliable materials that are capable of being stitched or otherwise affixed as described, and which are sturdy and durable in the various environments where the exercise apparatus may be used. However, this particular embodiment perhaps finds its greatest use in an aquatic setting. It is preferable therefore to fabricate the glove from a material that is somewhat elastic in order to make the mitt more or less form-fitting over the user's hand. Such elasticity assists in making sure that the weight is retained properly within the weight pocket 506 and helps to ensure that mitt remains firmly anchored on the user's hand, notwithstanding the considerable frictional forces encountered in water by the user during swimming or other aquatic athletic activities. As an example, a chlorine-resistant, heat insulating material such as closed-cell Neoprene may be used. With Neoprene, there is little or no variability in the weight of the apparatus due to minimal water retention within the glove; the product is durable; and the user's hands are kept at a desired temperature.

Figure 36:
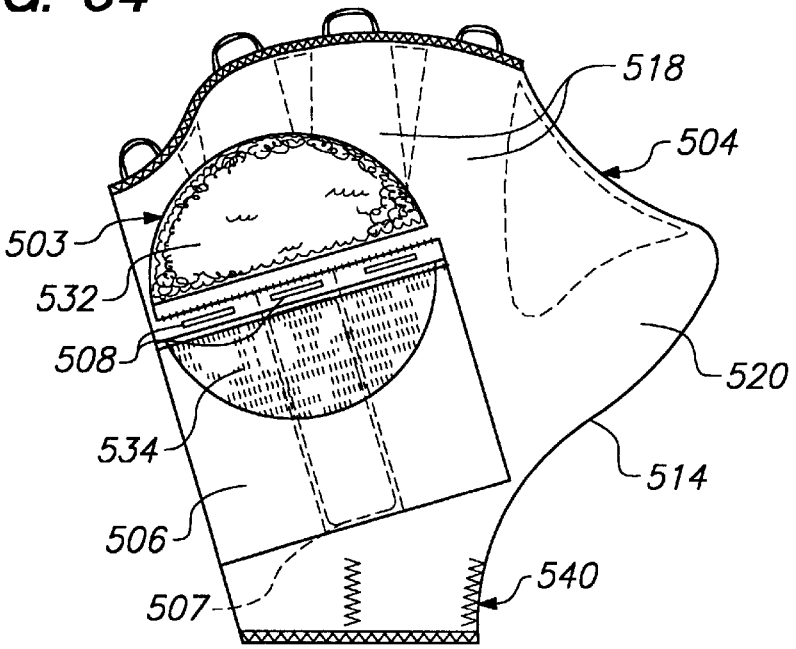
FIG. 36 is a backhand view of the same embodiment shown in FIG. 33, except that the flap has been folded back to show the openings of the weight pockets.
Figure 37:
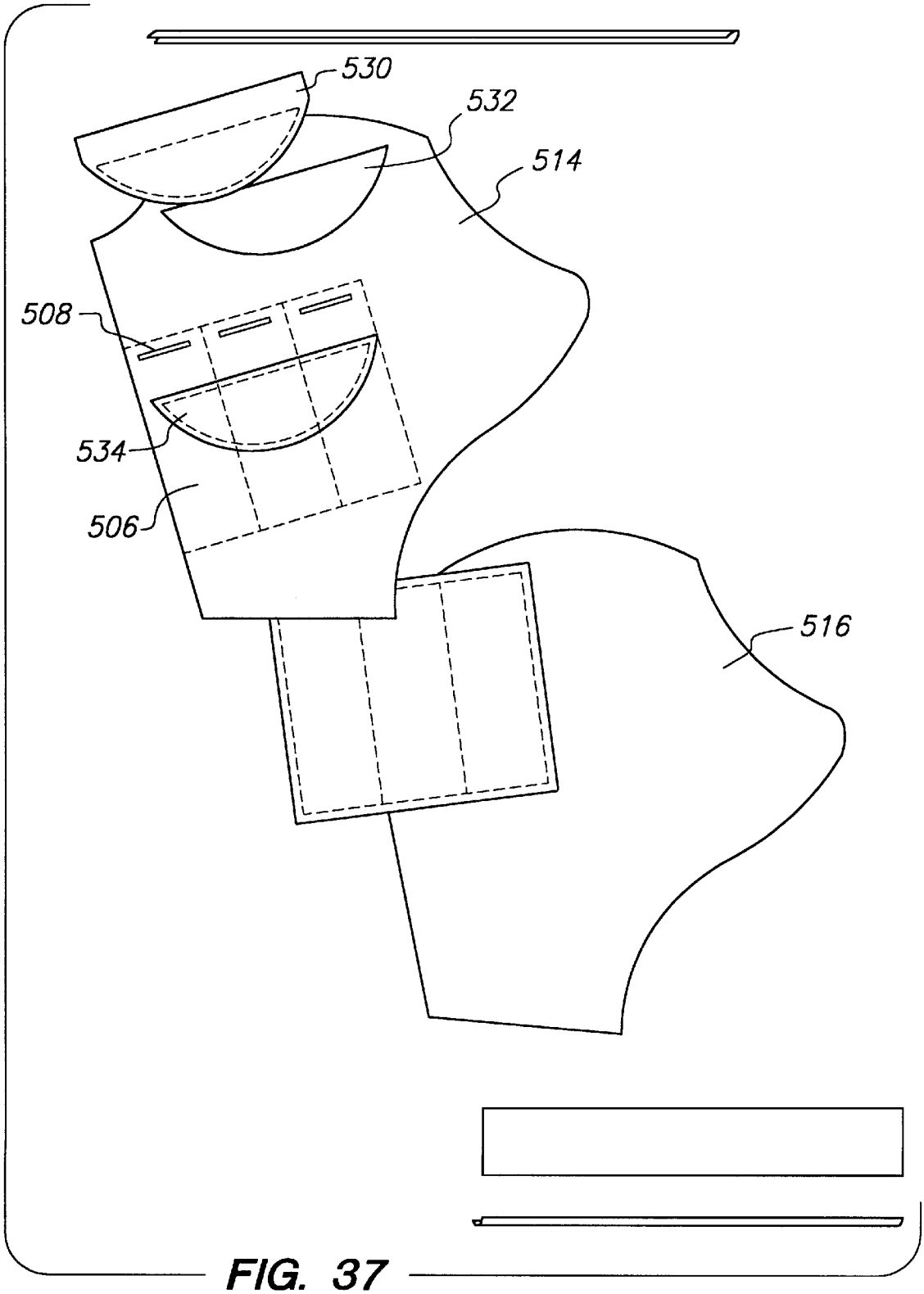
FIG. 37 is an exploded top view of the embodiment shown in FIG. 33.
Figure 38A:
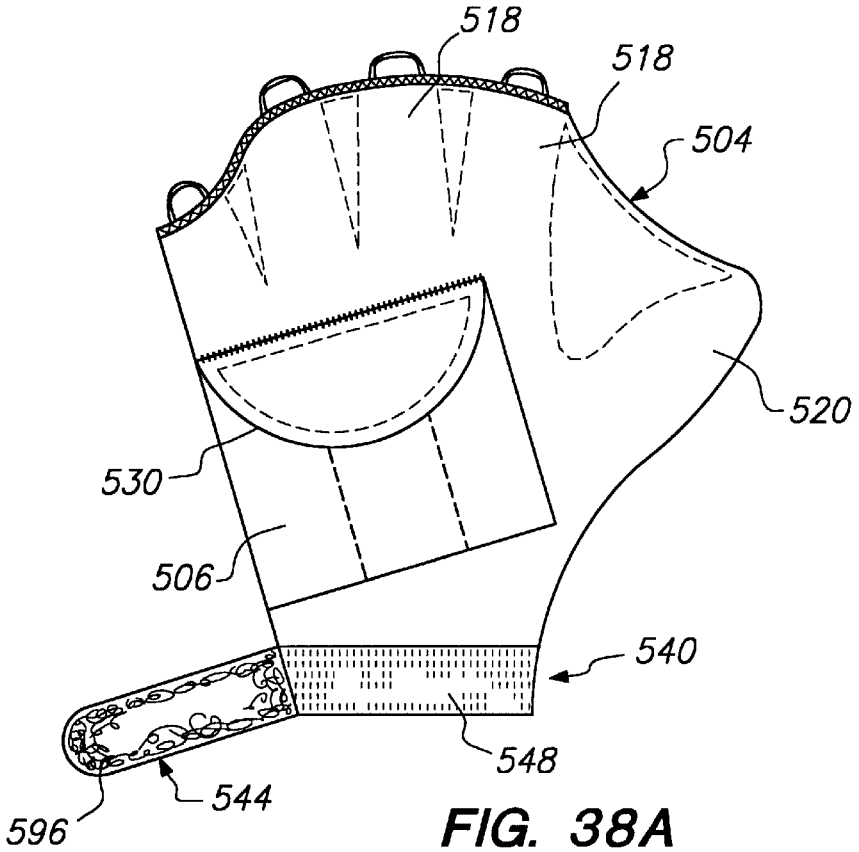
FIG. 38A is a backhand view of a third embodiment of the webbed and weighted aquatic exercise apparatus of the invention showing a wrist strap with hook and loop closure embodiment of the wrist securing means of the invention.
Figure 38B:
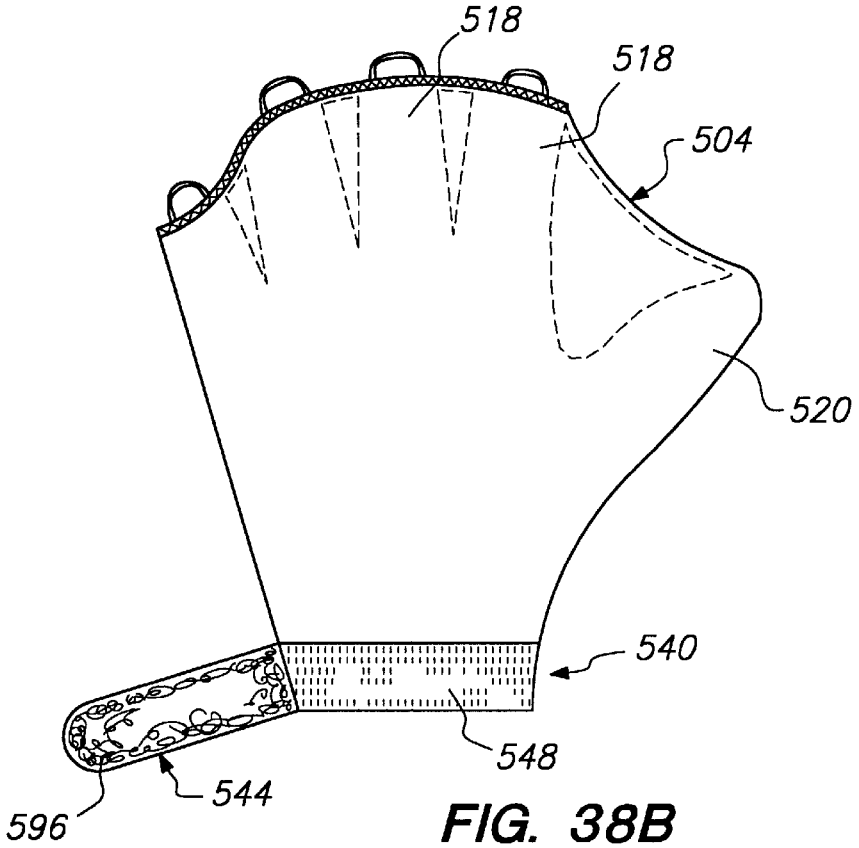
FIG. 38B is a palm view of the embodiment shown in FIG. 38A.
Figure 43:
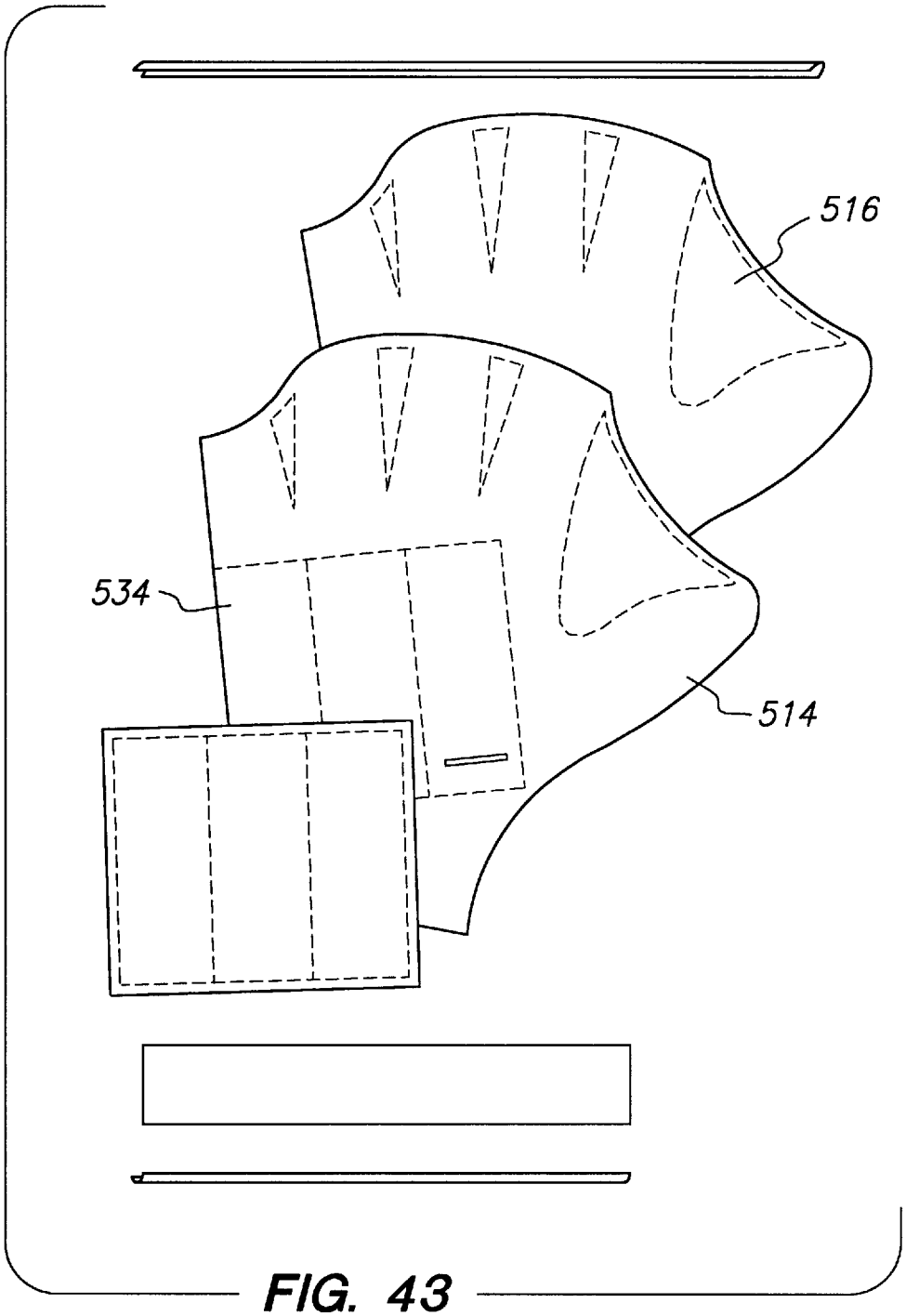
FIG. 43 is an exploded view of the embodiment shown in FIG. 41.
Figure 44:
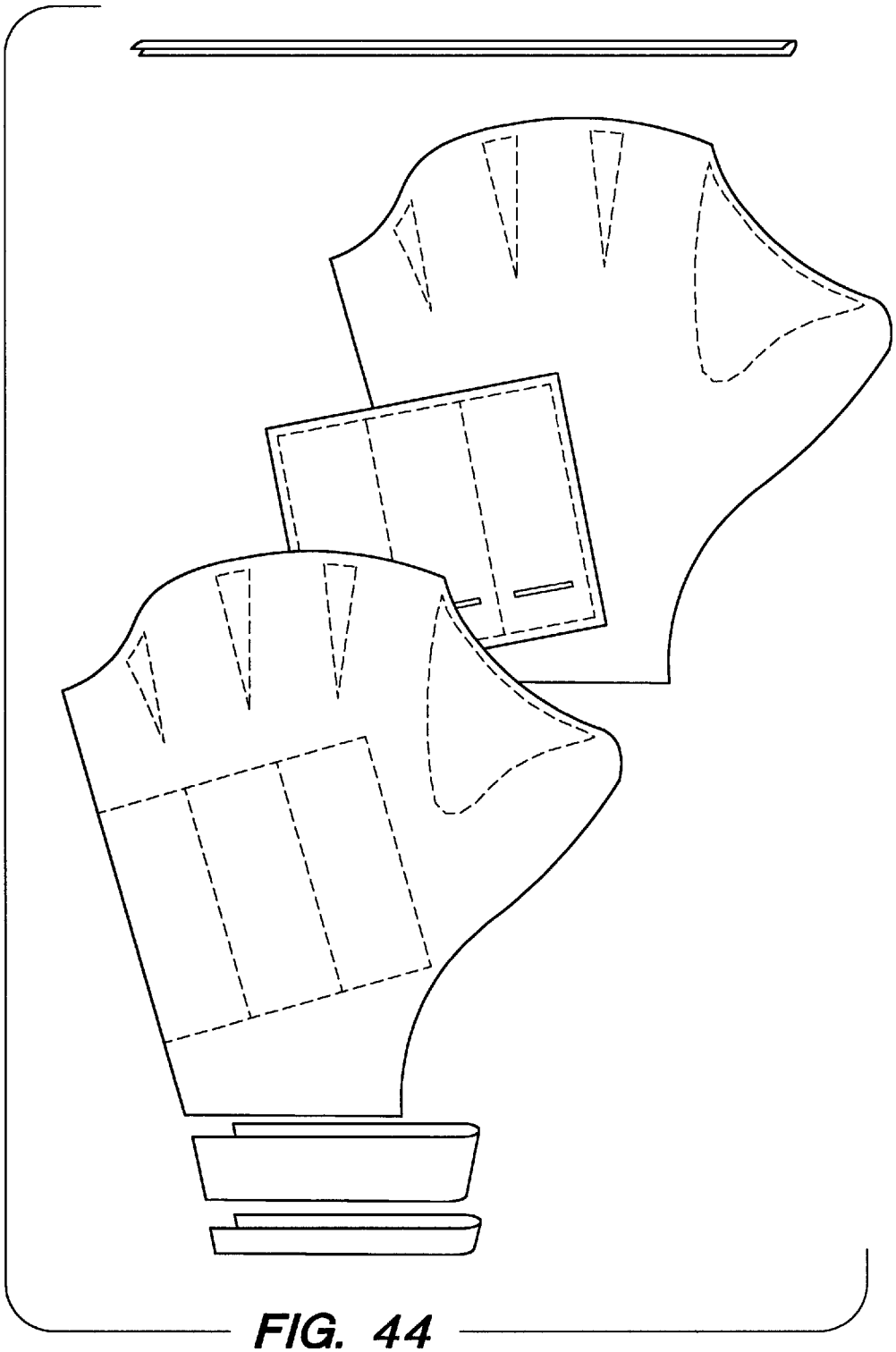
FIG. 44 is an exploded view of the embodiment of the invention shown in FIG. 40 except that the opening to the weight pockets are positioned toward the wrist end.

A modification of the embodiment just described is shown in FIGS. 36–38, wherein the mitt is further provided with one or more pockets 506 into each of which a weight 507 can be placed. One wall of the pocket 506 is formed from the backhand portion 514 of the mitt, which is provided with an opening or slit 508 through which a weight can pass. The interior wall of the pocket 506 is formed from backing 509 which is stitched together with the backhand portion 514 of the mitt to form each pocket 506. The weight pocket is further provided with a flap 530 that is attached to the backhand portion 514 of the mitt just above the row of slits 508 formed in the mitt. The reverse of the flap is provided a first hook and loop fastener portion 532. Its mate, hook and loop fastener portion 534, is affixed just below the row of slits 508 in a position symmetric to the position of flap 530. Thus, it will be understood that loop and hook fastener portion 532 can be folded over and mated with hook and loop fastener portion 534 in order to insure further that weights are not inadvertently lost from pockets 506 during exercise.

It will be appreciated that a variety of configurations of the exercise glove just described are possible. For example, it is possible to form the glove so that the weight pockets open interior to the glove, as shown in FIGS. 12–14, and FIGS. 39–44.

A third embodiment of aquatic exercise apparatus is illustrated in FIGS. 47–49. This embodiment is similar in most respects of structure and manufacture to the second embodiment of aquatic exercise apparatus described immediately above, except that the weights and structures for retaining weights within the glove have been omitted.

Figure 34:
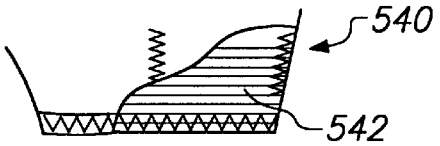
FIG. 34 is a partial view in cut away of the basal portion of the embodiment shown in FIG. 33 showing an elastic support embodiment of the wrist securing means of the invention.
Figure 35:
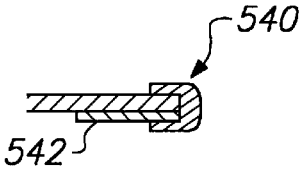
FIG. 35 is a partial view in cross section of the basal portion of the embodiment shown in FIG. 33 showing an elastic support embodiment of the wrist securing means of the invention.
Figure 45A:
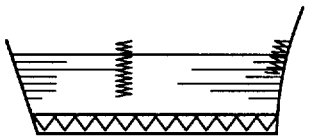
FIG. 45A is a view of an internally disposed elastic support embodiment of the wrist securing means of the invention internal to the glove.
Figure 45B:
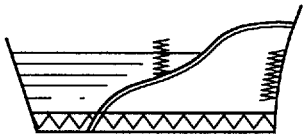
FIG. 45B is a partial cut away of the embodiment shown in FIG. 45A.

Each of the described embodiments of aquatic exercise apparatus may be further provided with a wrist securing means are also provided to ensure that the mitt does not become dislodged from the user's hand during exercise. Generally, the form-fitting configuration of the mitt and the preferably elastic nature of the mitt material will work together to anchor the exercise apparatus to the user's wrist. However, after continued use, the material of the mitt may stretch, and the user may experience "blow out." Blow out occurs when rapid or forceful movement of the hand transiently inflates the wrist portion of the mitt often resulting in the mitt slipping off the user's hand during use. To prevent this, the present embodiment includes a securing means 540 for keeping the fit of the mitt snug around the user's hand, particularly in the wrist area. The securing means 540 may comprise the addition of an elastic support band 542 that can be attached on the outer surface of the mitt at the wrist, as shown in FIG. 45; can be attached to the interior of the wrist, as shown in FIG. 34–35, or can even be cuffed over the base of the wrist portion to extend both interior and exterior of the glove as shown in FIG. 46, and may be partially or wholly circumferential in extent. The elastic support band should be comprised of a material that is elastic, but which does not stretch too easily, and which returns substantially to its original configuration after repeated stretching. Natural and synthetic rubbers, along with various elastic stretch fabrics and constructions, such as Lycra, would all be suitable materials for the elastic support band 542. Alternatively, as illustrated in FIG. 39, a strap 544 having a first portion 546 of a loop and hook fastener can be provided which mates with a second portion 548 of a loop and hook fastener positioned appropriately on the external surface of the wrist portion of the mitt. Thus, the strap 544 can be used to tighten or loosen the grip of the mitt about the wrist of the user as desired.

A further embodiment of the wrist securing means of the invention is illustrated in FIG. 49. Here, exercise apparatus 502 is provided with a self-securing strap 566 having a first end 568 securely attached exteriorly at a desired point on the wrist portion of the glove, and a free end 567. Adjacent to the point of attachment of strap 566 is a ring closure 570. Strap 566 is further provided with a Velcro strip 568 and a mating strip 569, thereby allowing strap 566 to be threaded through a ring closure 570 and securely mated with itself for securing the exercise apparatus 502 to the hand in a comfortable but stable manner.

III. Gloves Having Quick Removal Means

The invention further contemplates and provides structural modifications to the embodiments of gloved terrestrial exercise apparatus just described, as well gloves in general, for the quick and efficient removal of the glove after use.

Figure 10:
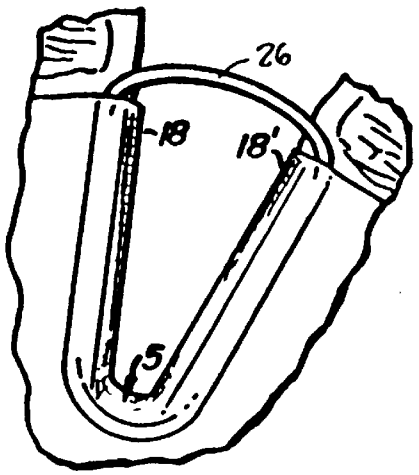
FIG. 10 is a cross sectional view of an embodiment of the glove quick removal means.

A first embodiment of this aspect of the invention is illustrated in FIGS. 1–3, 6, 7, 12, 13, 14, which show embodiments of the terrestrial gloved exercise apparatus described above incorporating the quick removal means. As can be seen in the figures, adjacent pairs of finger sleeves 18 are interconnected by means of loops 26 which facilitate removal of mitt 4 from the user's hand. Each of loops 26 in many of these embodiments is formed from substantially circular piece of material that extends between and interconnects a given pair of adjacent finger sleeves. As can be seen in FIG. 10, loop 26 extends from a first finger sleeve 18, through the interior region 5 of mitt 4 between backhand portion 14 and palm portion 16, and into a second finger sleeve 18' adjacent the first finger sleeve. Thus, the upper edge of adjacent finger sleeves 18, 18' includes a portion of loop 26 extending there between.

Those skilled in the art will recognize that other positions and manners of attaching the loops may be employed without interfering with the quick removal function of the loops. The loops are formed so that they may comfortably and readily receive the fingers of the user's hand and are positioned generally in the vicinity of the proximal phalanges. Formed and arranged in this manner, the loops provide unobtrusive "handles" by which the user may easily pull off the glove.

Figure 15:
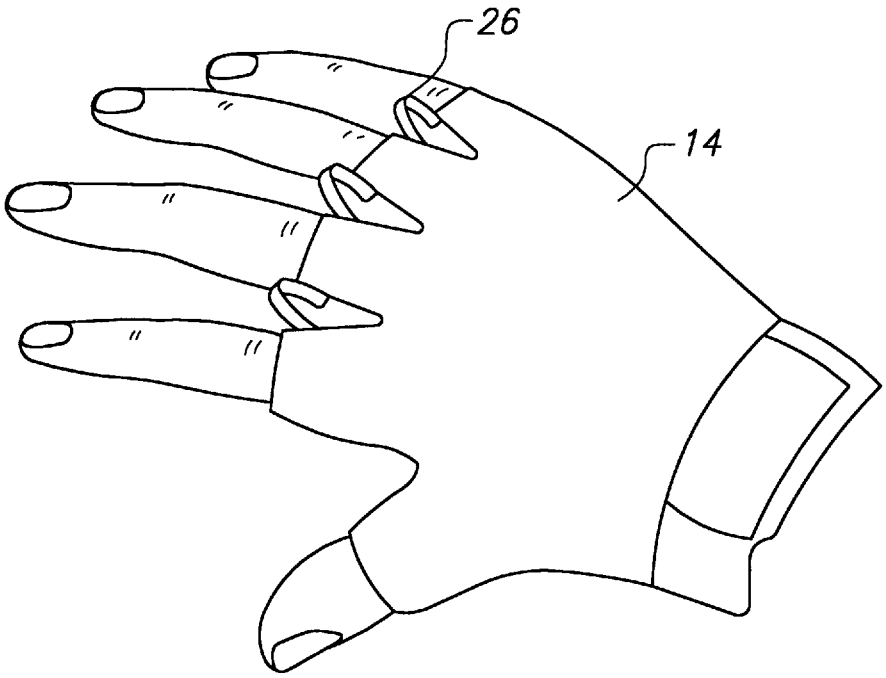
FIG. 15 is a perspective view of a half-fingered, form-fitting glove incorporating the quick removal means of the invention.
Figure 16:
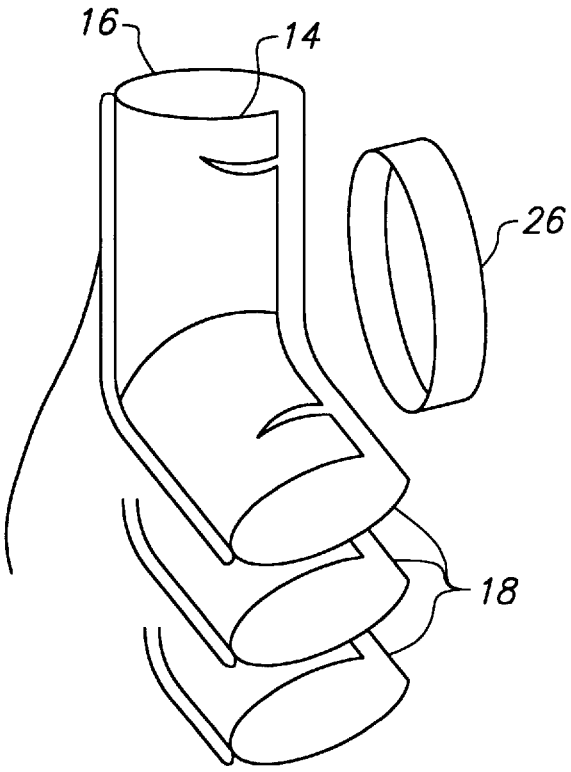
FIG. 16 is a view in perspective of the finger sleeves of the embodiment of FIG. 15, showing the slits on the backhand portion of the finger sleeves for receipt of a loop.
Figure 17:
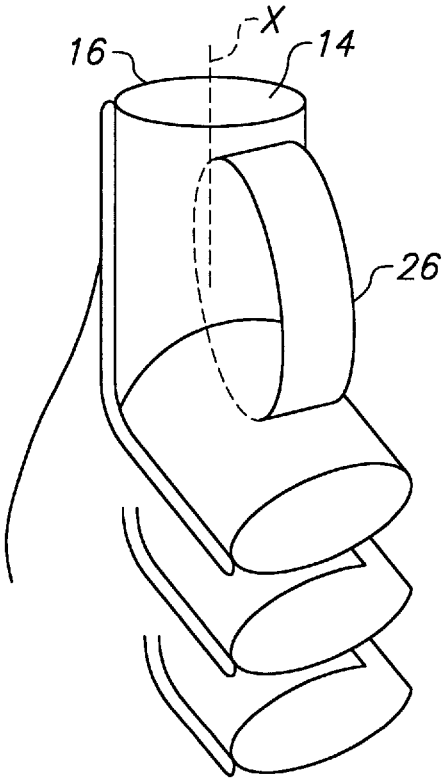
FIG. 17 is a view in perspective of the finger sleeves shown in FIG. 16 with the loop inserted above the midline between and made integral with an adjacent pair of finger sleeves.

In an alternative embodiment of invention, as shown in FIGS. 15–17, the loops 26 are inserted between the finger sleeves at a position biased toward the backhand portion 14 of the exercise apparatus 2. Loops so positioned will automatically be forced upward and out of the finger sleeve crotches when the finger sleeves are brought in contact with one another. This configuration increases the comfortability of the glove and minimizes any interference with exercise glove function by allowing the loops to be displaced to a position where they cannot be felt or interfere with any aspect of the user's full range of hand and finger motion.

More particularly, alignment of the loop configuration is accomplished by inserting each loop at a position on the finger sleeves 18 that lies above the theoretical plane that bisects the backhand portion 14 of the exercise apparatus from the palm portion 16, as shown in FIG. 17. In practice, this is achieved by slitting the finger sleeves 18 on the backhand portion 14 up to about the point where the backhand portion 14 of the finger sleeve 18 joins the palm portion 16 of the finger sleeve 18, as shown in FIG. 16.

Although individual loops interconnecting each pair of finger sleeves is contemplated in FIGS. 15–17, it will be appreciated that a single, continuous material could also be used, so long as the material is threaded through slits positioned in the backhand portion of the finger sleeves. So positioned, the loops 26, whether separate or continuous, become displaced above the backhand portion of the exercise apparatus during the use of the exercise apparatus, particularly as the fingers are brought together in order to clasp or grasp an object. Such displacement is advantageous in that it ensures the loops will not chafe between the fingers of the user, or otherwise interfere with the hand motion during a desired activity.

Figure 18:
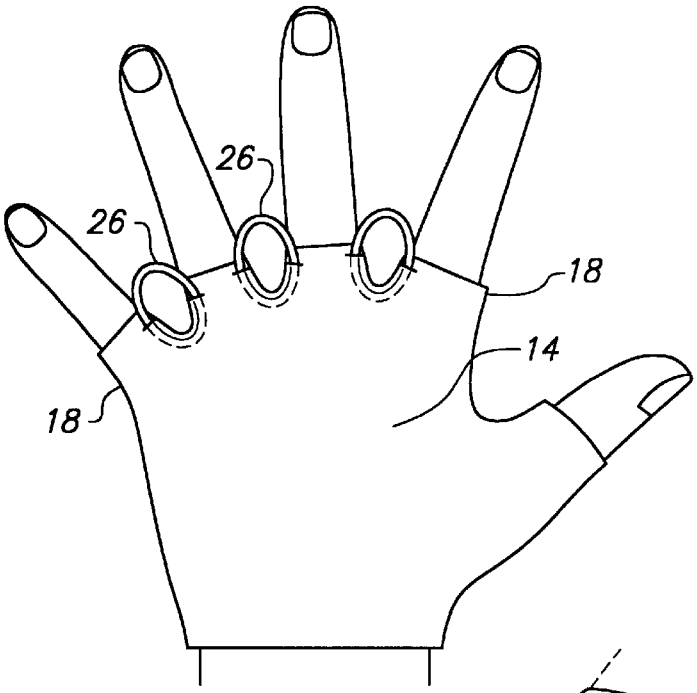
FIG. 18 is a backhand view of an alternative embodiment of a fingerless, form-fitting glove incorporating the quick removal means of the invention.
Figure 19:
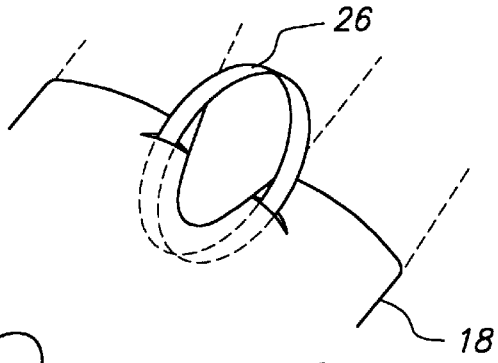
FIG. 19 is a partial view in perspective of the finger sleeves and quick removal means of the embodiment of the invention shown in FIG. 18.
Figure 20:
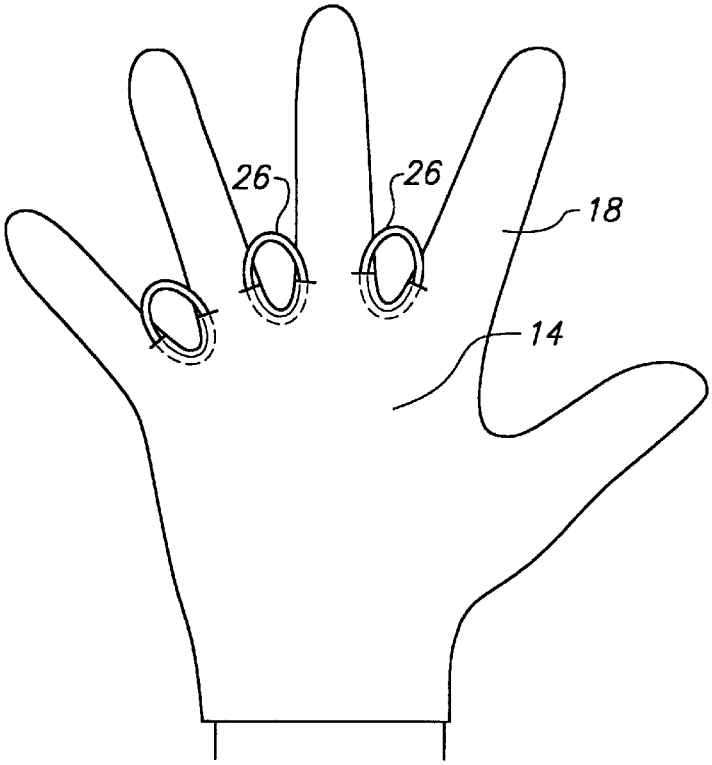
FIG. 20 is a backhand view of a closed fingered, form-fitting incorporating the embodiment of the quick removal means of the invention shown in FIG. 18.
Figure 21:
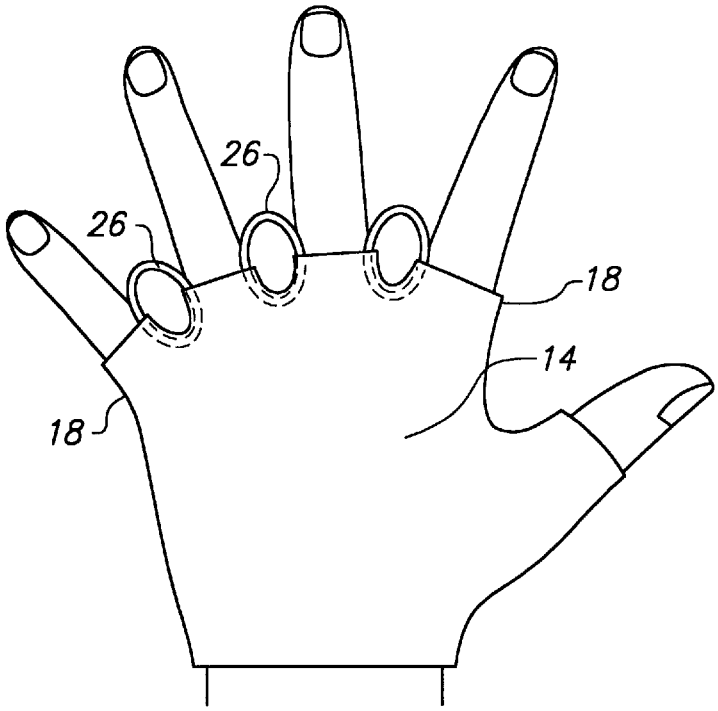
FIG. 21 is a backhand view of an embodiment of the quick removal means of the invention in which the loops extend medially through adjacent finger sleeves.
Figure 22:
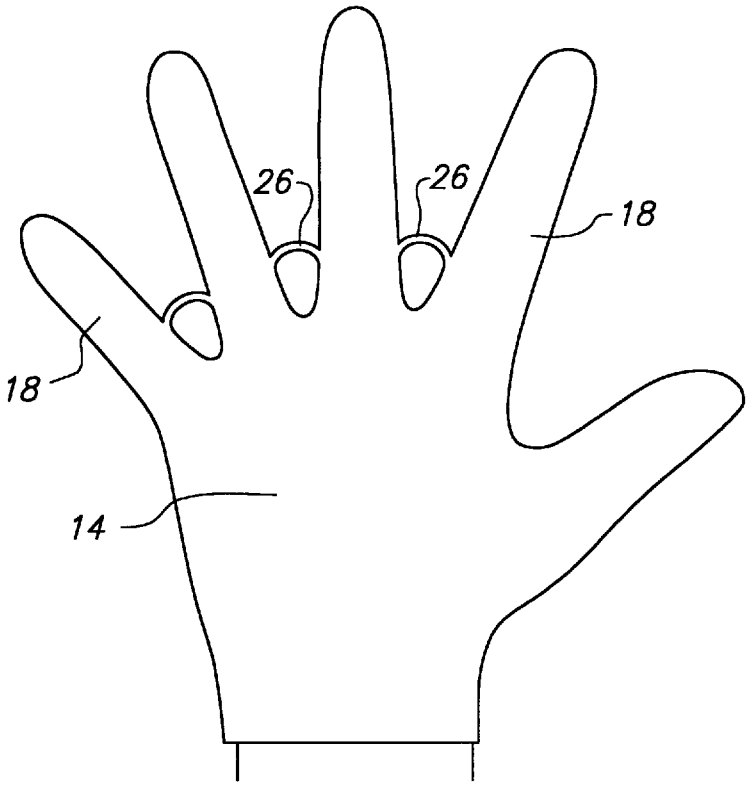
FIG. 22 is a backhand view of a further embodiment of the quick release means of the invention in which the loops are formed integrally with the finger sleeves of the glove.

Further embodiments of the quick removal aspect of the invention are illustrated in FIGS. 18–32. These embodiments illustrate the utility and applicability of the quick removal means of the invention to gloves generally. Embodiments of the quick removal means incorporated in gusset-lacking gloves is shown in FIGS. 18–20, including both full-fingered and half-fingered gloves. Here, the loops 26 inserted, either above the plane defined by the contact of the fingers with one another, as shown in FIGS. 18–20, or between the fingers, inserted directly through the finger sleeves, as shown in FIG. 21. Of course, it is also possible to preform a glove, such as from latex, plastic or other resilient material in which the loops are formed as an integral part of the glove, as shown in FIG.

Figure 23A:
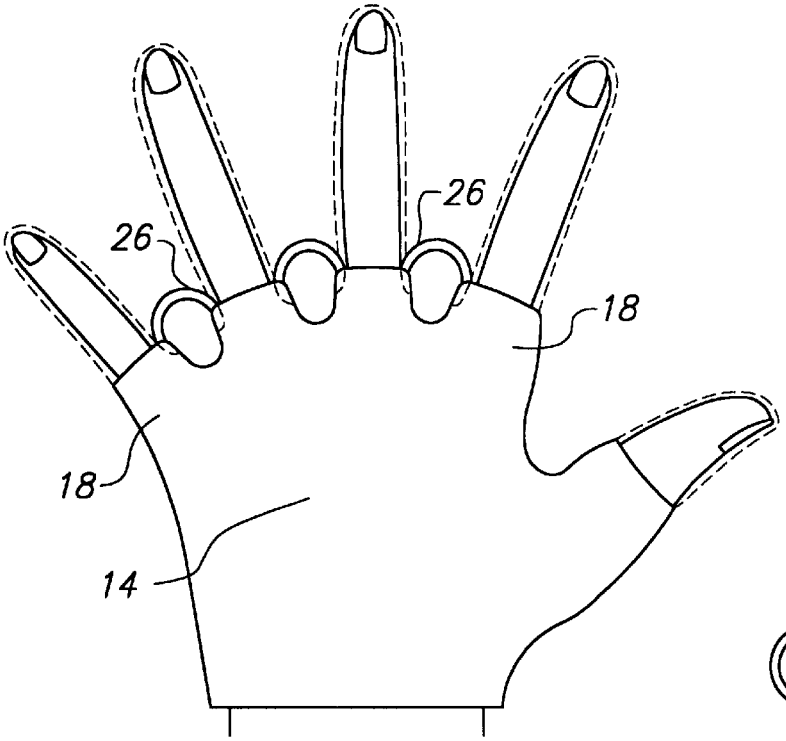
FIG. 23A is a backhand view of yet an embodiment of quick removal means of the invention in which loops are formed from substantially linear, arcuate segments of material bound internal to the finger sleeves.
Figure 23B:
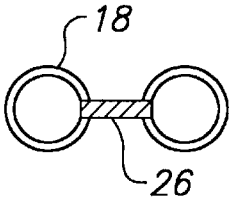
FIG. 23B is a cross-sectional view of the embodiment shown in FIG. 23A.
Figure 24A:
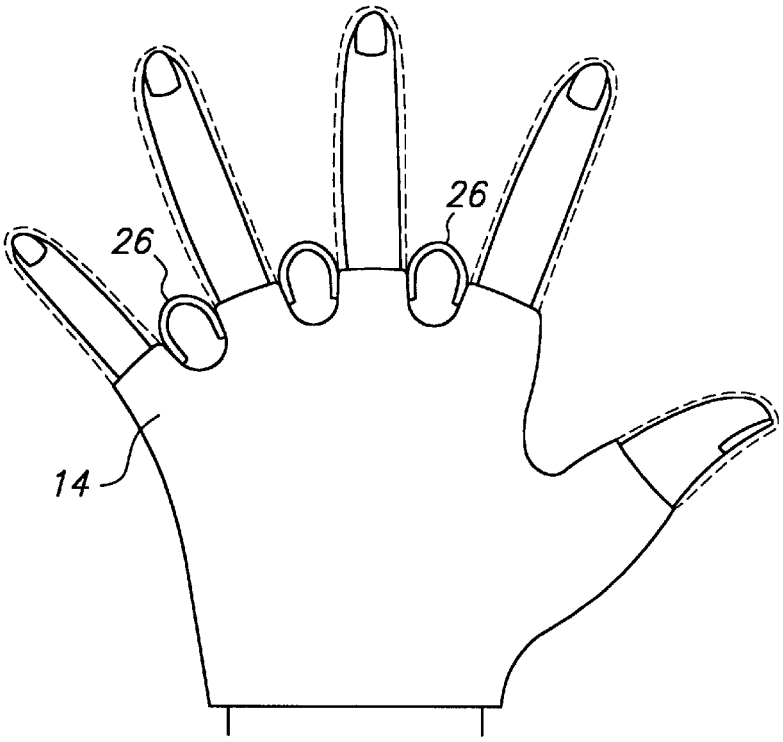
FIG. 24A is a backhand view of an embodiment of the quick removal means of the invention in which loops are formed from substantially linear, arcuate segments of material bound external to the finger sleeves.
Figure 24B:
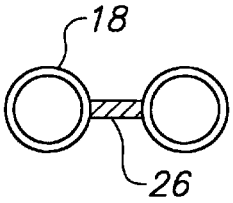
FIG. 24B is a cross-sectional view of the embodiment shown in FIG. 24A.

One skilled in the art will also appreciate that it is not necessary that the loops 26 be circular and continuous, or even that loops be disposed between each and every pair of adjacent finger sleeves. Rather, a loop may be fashioned of a strap of material that is affixed at a desired position to the exercise glove as shown in FIGS. 23–30. The loops 26 can be formed from straps that are affixed to the interior surfaces of the finger sleeves 18, as shown in FIG. 23, or to the exterior surface of the fingers sleeves as shown in FIG. 24.

Figure 25A:
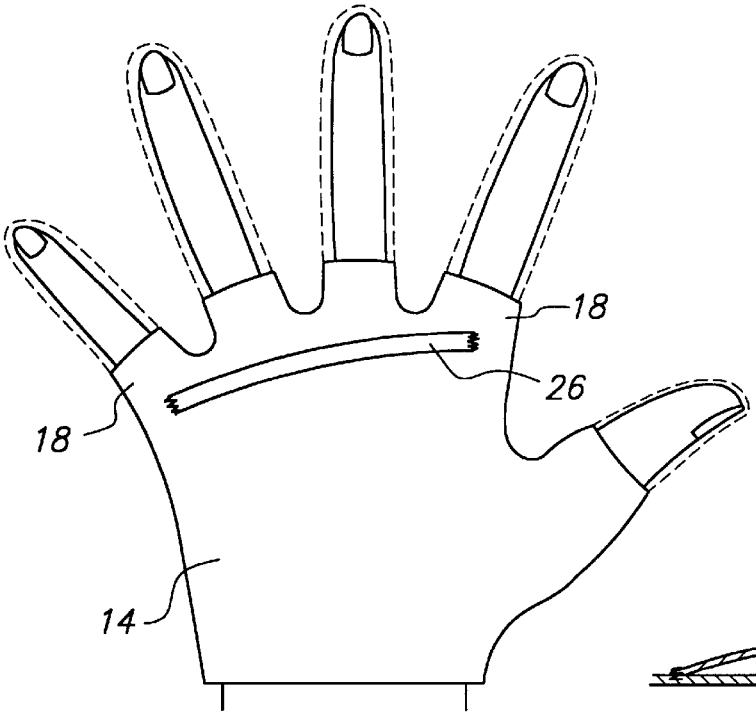
FIG. 25A is a backhand view of yet another embodiment of quick removal means of the invention which is represented by a laterally extending grasping strap
Figure 25B:
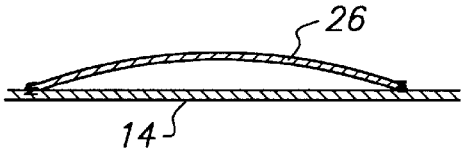
FIG. 25B is a cross-sectional view of the embodiment shown in FIG. 25A.
Figure 26A:
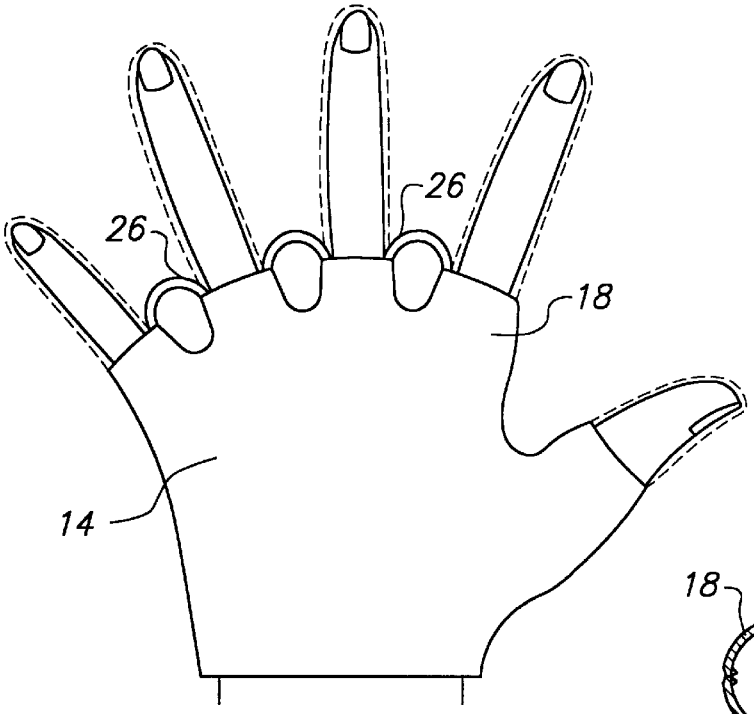
FIG. 26A is a backhand view of a further embodiment of quick removal means of the invention in which loops are formed from substantially linear, arcuate segments of material bound to the finger sleeves rims.
Figure 26B:
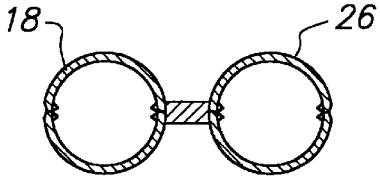
FIG. 26B is a cross-sectional view of the embodiment shown in FIG. 26A.
Figure 27A:
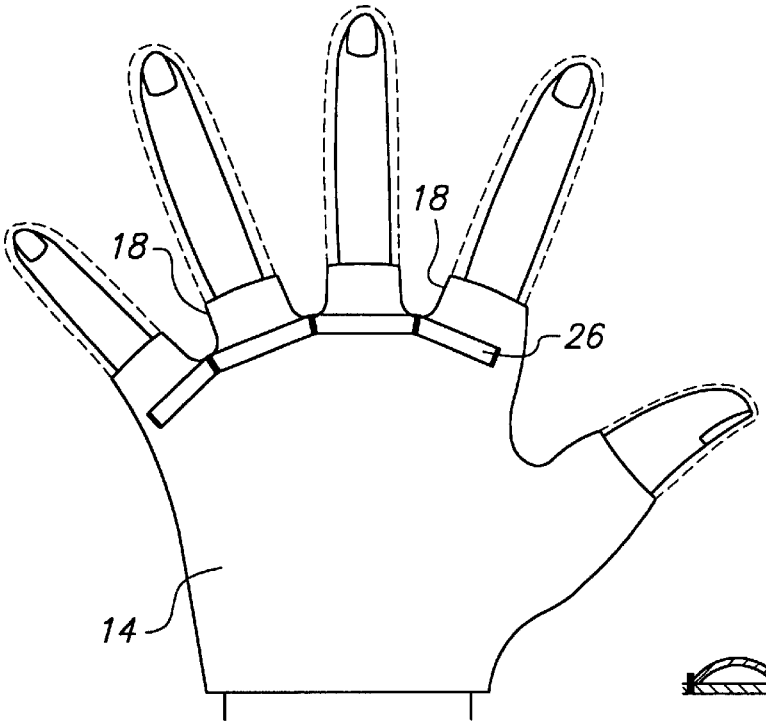
FIG. 27A is a backhand view of yet another embodiment of the quick removal means of the invention in which loops are formed exteriorly on the glove at the base of each finger sleeve.
Figure 27B:
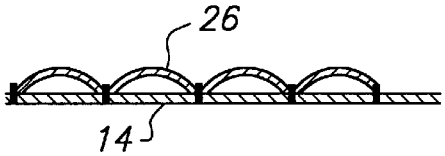
FIG. 27B is a cross-sectional view of the embodiment shown in FIG. 27A.
Figure 28A:
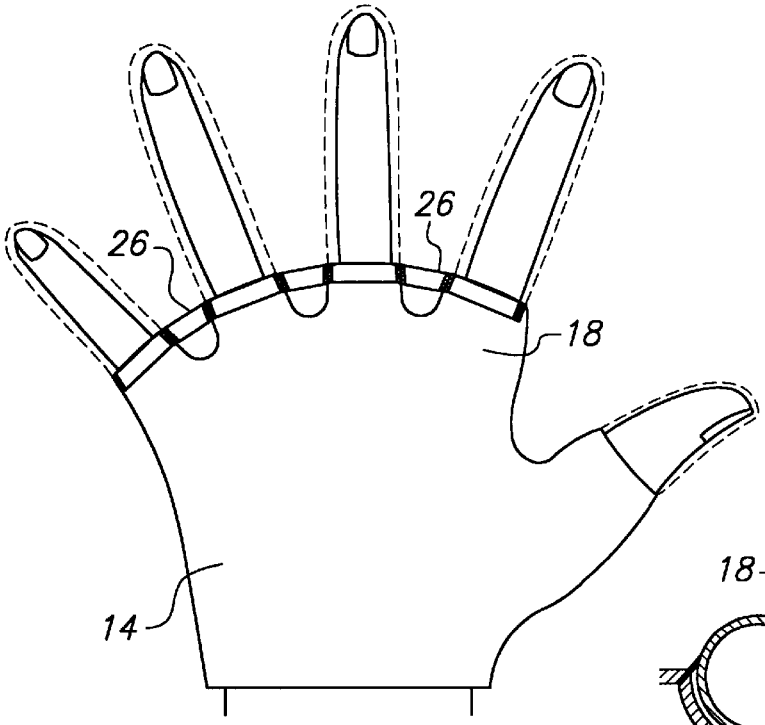
FIG. 28A is a backhand view of a further embodiment of the quick removal means of the invention in which a continuous, linear strip of material is attached externally to and extends across each finger sleeve to form loops between adjacent pairs of finger sleeves above each finger sleeve crotch.
Figure 28B:
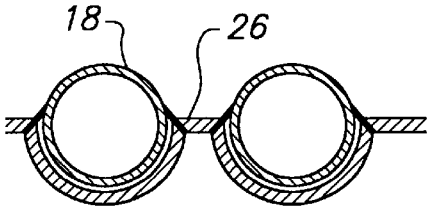
FIG. 28B is a cross-sectional view of the embodiment shown in FIG. 28A.
Figure 29A:
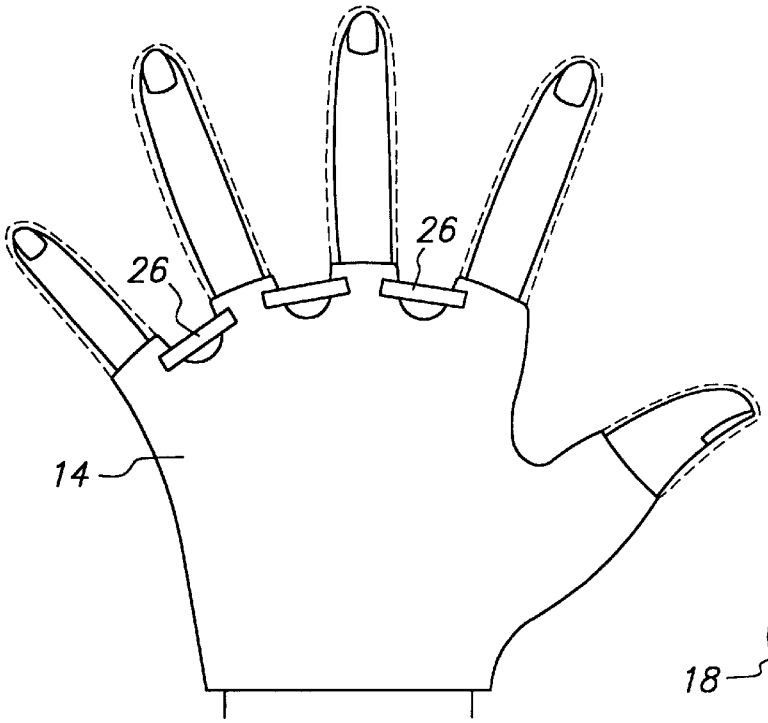
FIG. 29A is a backhand view of yet another embodiment of the quick removal means of the invention in which loops are formed from substantially linear, planar segments of material bound external to the finger sleeves above the backhand portion of each finger sleeve.
Figure 29B:
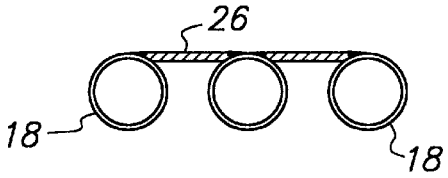
FIG. 29B is a cross-sectional view of the embodiment shown in FIG. 29A.
Figure 30A:
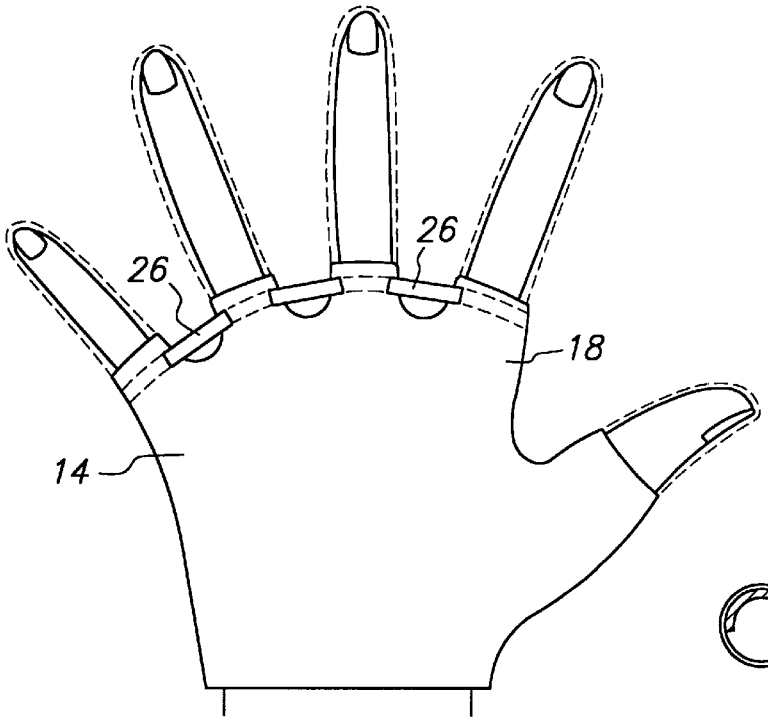
FIG. 30A is a backhand view of a further embodiment of the quick removal means of the invention in which a continuous, linear strip of material is attached internally to a portion of the backhand side and extends between each finger sleeve to form loops between adjacent pairs of finger sleeves above each finger sleeve crotch.
Figure 30B:
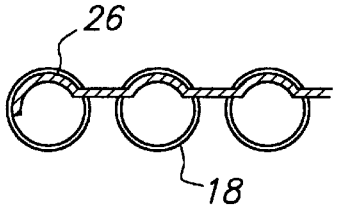
FIG. 30B is a cross-sectional view of the embodiment shown in FIG. 30A.

Alternatively, a strap may be affixed to the backhand portion of the exercise apparatus below the index and little fingers, as shown in FIG. 25. In this configuration, the user would clasp all his fingers around the loop (as opposed to individual fingers in each loop of the previously illustrated embodiment) and pull in order to remove the glove. If desired, such a loop can be tacked down or affixed at the base of the crotch formed between each pair of adjacent fingers, as shown in FIG. 27, or can be formed over and attached to the finger sleeves, as shown in FIG. 28. In both instances, a plurality of loops are formed, similar to the embodiments set forth in FIGS. 15–24. Further, the single strap of the embodiment illustrated in FIG. 28 can be woven through slits formed in the finger sleeves to provide a plurality of loops, as shown in FIG. 30. Alternatively, the single strap can be subdivided into a series of individual straps that can attached to adjacent pairs of finger sleeves as shown in FIG. 29.

Figure 31A:
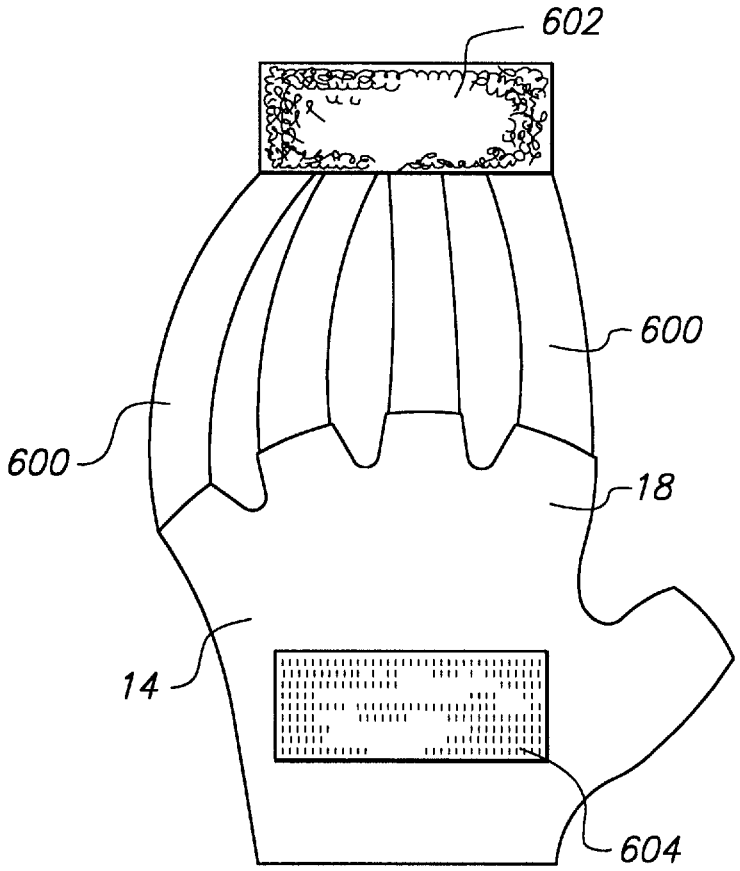
FIG. 31A is a backhand view of yet another embodiment of the invention showing the glove release means in operative position.
Figure 31B:
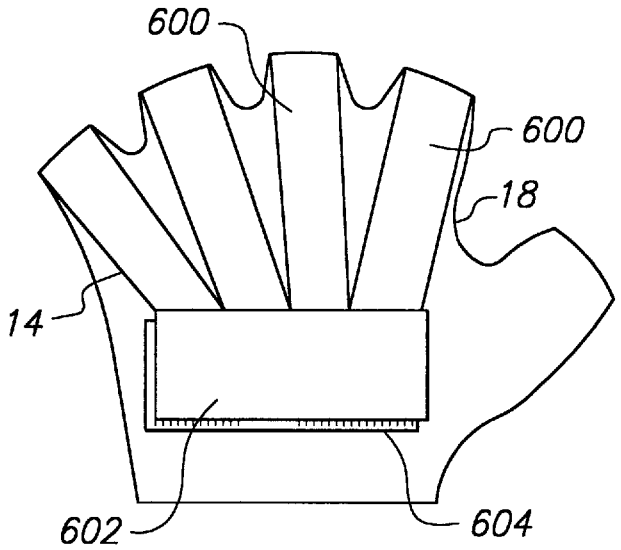
FIG. 31B is a top view of the embodiment shown in FIG. 31A in non-operative, retracted position.
Figure 32A:
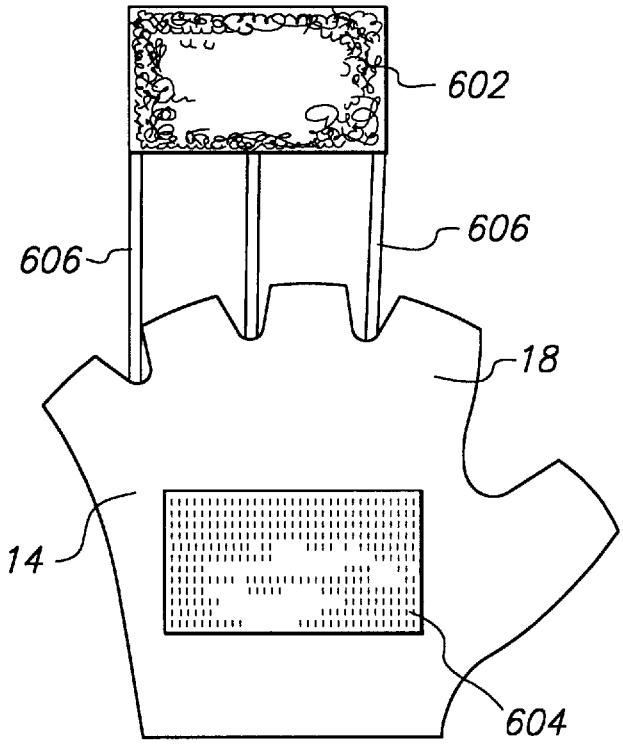
FIG. 32A is a backhand view of yet another embodiment of the invention showing the glove release means in operative position.
Figure 32B:
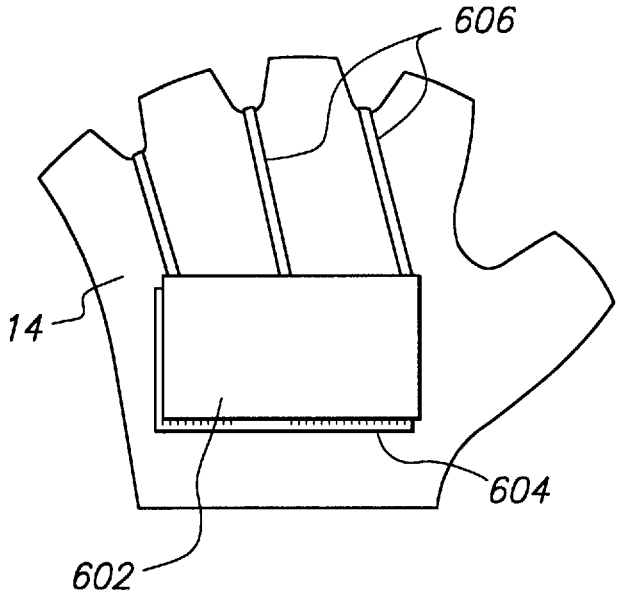
FIG. 32B is a backhand view of the embodiment shown in FIG. 32A in non-operative, retracted position.
Figure 33:
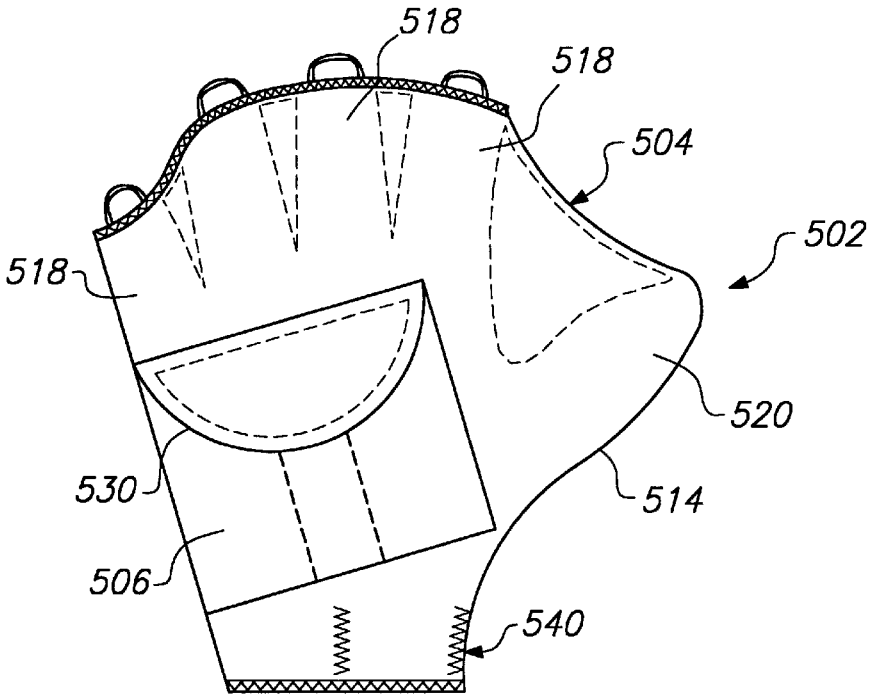
FIG. 33 is a backhand view of a second embodiment of the webbed and weighted aquatic exercise apparatus of the invention.

In an alternative embodiment, as shown in FIG. 31, the finger sleeves can each be provided with sleeve extensions 600 extending from the backhand side of each finger sleeve. Extensions 600 are connected to a grasp pad 602, which is pulled back and affixed to a catch 604 when not in use. Affixation of the grasp pad to the catch can be accomplished by another number of known methods, such as for example providing opposing sides of the grasp and catch with a hook and loop fastening system, as described further above. FIG. 32 shows a modified version of the embodiment just described, wherein the finger sleeve extensions 600 have been replaced by strings 606 which are attached at the base of each crotch between adjacent finger sleeves at one end and to a grasp pad 602 at the other end. In operation, both embodiments function similarly. In order to remove the glove, the user detaches and pulls the grasp pad with his free hand, thereby pulling the glove free from the hand.

It will now be apparent that the present invention overcomes difficulties and short comings present in existing exercise apparatus and gloves in significant and surprising ways. The invention provides a convenient and efficient means of enhancing the aerobic value and efficiency of terrestrial exercise through the securing of weights to the back portion of a user's hand without the need to grasp or otherwise impede the full range of hand and finger movement that may be required by other aspects of the exercise activity. Further, the amount of weight can be adjusted, either before or during exercise, to be complimentary to a particular exercise activity or to the level of conditioning achieved by the user at any given time. Although a glove may be used to support and position the weight, such use is not required, making the exercise apparatus of the invention less costly to manufacture and easier to attach.

The invention further provides significant improvements over prior art exercise apparatus for use in aquatic environments, particularly in the case of swim gloves or mitts. Most significant perhaps is the significantly increased aerobic benefit afforded by the weighted embodiments which permit the user to increase resistance and muscle tension both when the hand is moving in water and in air. Further, the use of weights permits the aerobic quality of the glove to be varied more easily and more intensely than prior art gloves that are capable of enhancing aerobic activity only when the glove is in water and in which the intensity of aerobic activity cannot be varied because surface area of the webbing, and the increased drag created thereby, is fixed. The invention virtually eliminates the need for straps, pads or other securing devices to retain the weights in a fixed, non-moving position relative to the user's hand, permitting the user to add or remove weight even while exercise is in progress.

Also advantageous are properties afforded by the use of improved fabrication materials, such as Neoprene, which are more durable; retain desired elasticity for longer periods of time; provide desirable insulating properties and are more or less impermeable to water thereby making the glove easier to wear and control during extended periods of exercise.

A further significant advantage of aquatic gloved exercise apparatus embodiments is the provision of an inexpensive but effective wrist securing means for ensuring that the glove remains snug throughout in fit and for preventing the undesired forced movement of water into the interior of the apparatus during exercise that may result from an overstretched or otherwise deformed wrist portion of the apparatus. A ring closure will enable securing and releasing of the wrist securing means for the exercise apparatus using only one hand. This is especially important since additionally, with webbed gloves, manual dexterity is limited.

Finally, the invention provides a solution to the long felt need for facilitated removal of gloves generally and exercise gloves in particular through the use of loops which interconnect finger pairs of adjacent finger sleeves and provide a way of simultaneous leveraging o all finger sleeves. Although neither structurally complex nor expensive to manufacture, the solution is nevertheless highly effective in expediting glove removal and is elegant in its design. Although the invention has been described with reference to certain illustrated embodiments, those skilled in the art will recognize that variations and modifications can be made without departing from the scope of the invention, which is set forth and defined by the claims that follow.

I claim:

1. A swimming glove for use in swimming and other aquatic athletic activities, comprising:

a) a mitt having a backhand portion and a palm portion, said portions together defining an interior space for receipt of a hand of a user, said mitt basally provided with a wrist portion having an opening;

b) a plurality of finger channels for receiving fingers of the user, each of said finger channels having a proximal end open to the interior space of the mitt and a distal end;

c) webbing disposed between the finger channels to provide for a substantially continuous surface of the glove;

d) at least one pocket disposed on the backhand portion of the mitt, and configured to receive a weight, and e) wherein said glove comprised of elements a) through d) is a swimming glove.

2. The glove of claim 1 wherein the finger channels are open at the distal ends and the webbing between said channels extends to the distal region of said finger channels.

3. The glove of claim 1 wherein said mitt is fabricated substantially of elastic materials which are resistant to deterioration in aquatic environments; are heat insulating; are substantially impermeable to water; and provide for cushioning of said at least one weight.

4. The glove of claim 3 wherein the elastic material is closed-cell neoprene.

5. The glove of claim 1 further comprising:

a) a flap having a circumferential edge;

b) mounting means for attaching said flap along a substantially linear segment of the circumferential edge to the external side of the backhand portion at a point proximate to the openings of said at least one pocket; and c) fastening means for reversible securing of said flap in substantially flush planar contact with the external surface of the backhand portion of said mitt over the openings of said at least one pocket, wherein said flap is disengaged from said fastening means and folded out of planar contact with said backhand portion of said mitt to permit insertion and removal of weights.

6. The glove of claim 1 further comprising:

a) a flap having a circumferential edge with a first attached portion and a second free portion; and b) mountings means for securing said flap permanently in a fixed position over the openings of said at least one pocket in substantially flush planar contact with the external surface of the backhand portion of said mitt, wherein said flap is deformed and thereby lifted from contact with the backhand portion of the glove to permit insertion and removal of weights.

7. The glove of claim 1 wherein the wrist portion of said mitt further comprises a means for snugly securing said mitt about the user's wrist.

8. The glove of claim 7 wherein said means for securing said mitt comprises an elastic support affixed to and disposed along at least a portion of the opening of the wrist portion of said mitt.

9. The glove of claim 8 wherein the elastic support is mounted on an internal surface of the wrist portion of the glove.

10. The glove of claim 7 wherein said snugly securing means comprises a reversible, self adhering strap and ring closure system, wherein said strap is passed through said ring and pulled back on itself to provide a customized snug fit.

11. The glove of claim 10 wherein said self-adhering strap utilizes a hook and loop fastener.

* * * * *